US012331428B2

(12) United States Patent
May et al.

(10) Patent No.: US 12,331,428 B2
(45) Date of Patent: Jun. 17, 2025

(54) METHODS FOR MAKING SYNTHETIC HAIR FROM PLANT FIBER

(71) Applicant: REBUNDLE, Inc., St. Louis, MO (US)

(72) Inventors: Ciara I. May, St. Louis, MO (US); Cynthia Chapple, St. Louis, MO (US); Phylicia Patton, St. Louis, MO (US)

(73) Assignee: REBUNDLE, INC.

( * ) Notice: Subject to any disclaimer, the term of this patent is extended or adjusted under 35 U.S.C. 154(b) by 306 days.

(21) Appl. No.: 17/966,622

(22) Filed: Oct. 14, 2022

(65) Prior Publication Data

US 2023/0340700 A1 Oct. 26, 2023

Related U.S. Application Data

(60) Provisional application No. 63/333,428, filed on Apr. 21, 2022.

(51) Int. Cl.
*D01C 1/00* (2006.01)
*A41G 3/00* (2006.01)
(Continued)

(52) U.S. Cl.
CPC ..... *D01C 1/04* (2013.01); *A41G 3/0083* (2013.01); *D06P 3/008* (2013.01); *D10B 2201/01* (2013.01); *D10B 2503/08* (2013.01)

(58) Field of Classification Search
CPC ..... D01C 1/04; D01C 1/02; A41G 3/0083; D06P 3/008; D06P 3/6008; D06P 3/6033;
(Continued)

(56) References Cited

U.S. PATENT DOCUMENTS 1,214,007 A * 1/1917 Burton ..... C08L 89/005 8/930
2,438,005 A 3/1948 Goldman
(Continued)

FOREIGN PATENT DOCUMENTS

CN 100424237 C 10/2008
CN 102277625 A 12/2011
(Continued)

OTHER PUBLICATIONS

International Search Report and Written Opinion for International Application No. PCT/US2023/66063, Mailed on Aug. 29, 2013, 09 pages.
(Continued)

*Primary Examiner* — Eisa B Elhilo
(74) *Attorney, Agent, or Firm* — POLSINELLI PC

(57) ABSTRACT

The present disclosure provides methods for making synthetic hair compositions. The methods generally comprise providing a plant fiber, degumming the plant fiber, and dyeing the plant fiber. The present disclosure also provides methods of degumming banana fiber. The methods generally comprise providing banana fiber and soaking the banana fiber in a degumming solution comprising a base, magnesium sulfate, and hydrogen peroxide. The present disclosure further provides methods of dyeing banana fibers. The present disclosure further provides synthetic hair compositions comprising banana fibers made by the methods described herein.

19 Claims, 16 Drawing Sheets

(51) Int. Cl.
*D01C 1/04* (2006.01)
*D06P 3/00* (2006.01)

(58) Field of Classification Search
CPC . D06P 3/62; D06P 3/6016; D06P 3/66; D10B 2201/01; D10B 2503/08; D06M 2101/04; D06M 2200/50; D06M 11/76; D06M 15/03; D06M 15/15; D06M 11/50; D06M 11/56; D06M 16/003
USPC ..... 8/920, 931
See application file for complete search history.

(56) References Cited

U.S. PATENT DOCUMENTS

| | | | | |
|---|---|---|---|---|
| 3,830,245 | A | 8/1974 | Abbott et al. | |
| 4,386,619 | A | 6/1983 | Williams | |
| 4,568,739 | A | 2/1986 | Jaskowski | |
| 5,356,439 | A * | 10/1994 | Schultz | D06P 1/65168 8/405 |
| 5,979,462 | A | 11/1999 | Jones | |
| 8,357,487 | B2 | 1/2013 | Liu et al. | |
| 9,206,544 | B2 | 12/2015 | Zeng et al. | |
| 9,869,058 | B2 | 1/2018 | Zhang et al. | |
| 9,938,663 | B2 | 4/2018 | Powars | |
| 2004/0168696 | A1 | 9/2004 | Cox | |
| 2014/0202481 | A1 | 7/2014 | Sato et al. | |
| 2017/0044712 | A1 * | 2/2017 | Powars | D21C 1/08 |
| 2019/0112571 | A1 | 4/2019 | Medoff et al. | |
| 2020/0102694 | A1 * | 4/2020 | Castro Erazo | D06L 4/15 |

FOREIGN PATENT DOCUMENTS

| | | | | |
|---|---|---|---|---|
| CN | 103993488 | A * | 8/2014 | |
| DE | 1938504 | A1 | 1/1971 | |
| DE | 2141838 | A | 2/1972 | |
| FR | 2085482 | A1 | 12/1971 | |
| FR | 2794002 | A1 | 12/2000 | |
| FR | 2967555 | A1 | 5/2012 | |
| FR | 3100108 | A1 | 3/2021 | |
| JP | H0726331 | Y2 | 6/1995 | |
| JP | 2003306821 | A | 10/2003 | |
| JP | 2007321298 | A | 12/2007 | |
| JP | 2008163497 | A | 7/2008 | |
| JP | 5329878 | B2 | 10/2013 | |
| JP | 6062260 | B2 | 1/2017 | |
| KR | 20100075012 | A | 7/2010 | |
| KR | 20100095084 | A | 8/2010 | |
| WO | 2011148136 | A2 | 12/2011 | |
| WO | WO 2015028499 | A1 * | 3/2015 | C09B 67/0055 |
| WO | 2019/142542 | A1 | 7/2019 | |

OTHER PUBLICATIONS

Bio Jigsaw: "Bio Jigsaw Ltd. Royal Organic Hair. Bio-product training. Bio technology. Press Release", (Jul. 5, 2018), XP055688434, Accessed on Apr. 22, 2020 at: URL:http://biojigsaw.com/press-release/.

* cited by examiner

METHODS FOR MAKING SYNTHETIC HAIR FROM PLANT FIBER

CROSS-REFERENCE TO RELATED APPLICATIONS

This application claims priority to U.S. Provisional Application No. 63/333,428 filed Apr. 21, 2022, the entirety of which is incorporated herein by reference.

FIELD OF THE DISCLOSURE

The present disclosure is related to processes for making synthetic hair made out of plant fibers. Accordingly, the disclosure is related to the fields of chemistry and chemical engineering.

BACKGROUND

Many women desire protective hairstyles such as braids and twists. To create this hairstyle, additional hair is needed to give the illusion of longer hair. Synthetic braiding hair is the material used to create the desired protective style. Unfortunately, synthetic braiding hair has a rough texture and contains chemical smells. Synthetic hair is also commonly made from plastics such as acrylic or nylon, whereas many users prefer natural products. Additionally, synthetic braiding hair can cause irritation to the scalp of the users. The irritation can include itchiness, redness, burning, bumps, and in some cases, it can cause hair loss.

There is a need for braiding hair that is safe for women with sensitive scalps.

SUMMARY

Described herein are methods of making synthetic hair from plant fiber. The method comprises providing a plant fiber, degumming the plant fiber, and dyeing the plant fiber. In some embodiments, the plant fiber is banana fiber. In some aspects, the method further comprises conditioning the plant fiber after degumming the plant fiber. In some additional aspects, the method further comprises neutralizing the plant fiber after dyeing the plant fiber. In still further aspects, the method further comprises rinsing and scouring the plant fiber after dyeing the plant fiber. In still further aspects, the method further comprises detangling, combing, and/or braiding the banana fiber after dyeing the banana fiber.

In some embodiments, the degumming comprises soaking the plant fiber in an alkaline hydrogen peroxide solution. In some aspects, the alkaline hydrogen peroxide solution comprises a base, magnesium sulfate, and hydrogen peroxide.

In some embodiments, the dyeing is accomplished with a dye solution comprising dye, a salt, and soda ash.

In some embodiments, the method further comprises soaking the banana fiber in an alkaline pre-soak solution prior to degumming the banana fiber. In some aspects, the alkaline pre-soak solution comprises water and a strong base. In still further aspects, the alkaline pre-soak solution may comprise an enzyme, such as pectinase.

In some embodiments, the method further comprises soaking the plant fiber in an acid solution prior to degumming the plant fiber. In some aspects, the the acid solution comprises a strong acid or an organic acid.

Further described herein are methods of degumming banana fiber. The methods generally comprise providing banana fiber and soaking the banana fiber in a degumming solution. Generally, the degumming solution comprises a base, magnesium sulfate, and hydrogen peroxide. In some embodiments, the method further comprises soaking the banana fiber in an alkaline pre-soak solution and rinsing the banana fiber prior to soaking the banana fiber in the degumming solution.

Further described herein are methods of dyeing banana fiber. The methods generally comprise soaking the banana fiber in a dye solution. Generally, the dye solution comprises a dye, a non-iodized salt, and soda ash. In some embodiments, the dye comprises a reactive dye powder.

Further described herein are synthetic hair compositions that are made using any of the methods described herein.

BRIEF DESCRIPTION OF THE DRAWINGS

FIG. 2A shows the factors affecting color. FIG. 2B shows the factors affecting texture. FIG. 2C shows the factors affecting density. FIG. 2D shows the factors affecting the concentration of cellulose. FIG. 2E shows the factors affecting the concentration of xylan. FIG. 2F shows the factors affecting the concentration of lignin.

FIG. 3A shows a picture of sample A. FIG. 3B shows a picture of sample B. FIG. 3C shows a picture of sample C. FIG. 3D shows a picture of sample D. FIG. 3E shows a picture of sample E.

FIG. 4A shows a picture of sample A. FIG. 4B shows a picture of sample B. FIG. 4C shows a picture of sample C. FIG. 4D shows a picture of sample D. FIG. 4E shows a picture of sample E.

FIGS. 5-5E shows photographs of the bundles tested in the enzyme evaluation described in Example 8. FIG. 5E shows a picture of sample E.

DETAILED DESCRIPTION

Figure 1A:
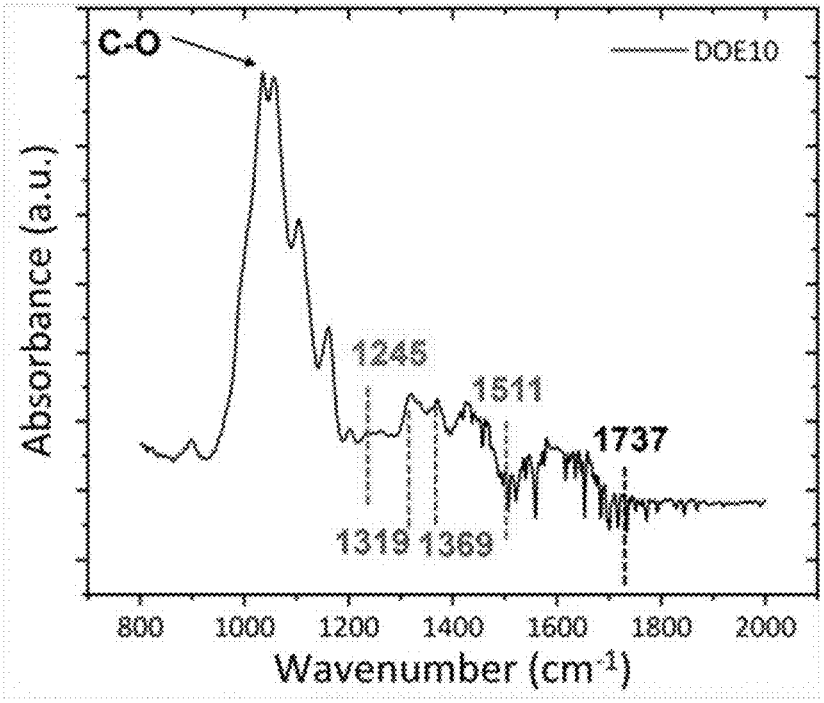
FIGS. 1A-1B show FTIR spectra for degummed banana fibers prepared before treatment with cetrimonium bromide (CTAB) (FIG. 1A) and after treatment with CTAB (FIG. 1B).

Provided herein are methods of making synthetic hair from plant fibers. Plant fibers provide an environmentally-friendly alternative to other synthetic hair products, which generally include plastics. The hair can be braided without causing itchiness or irritation to the scalp of a user. The methods generally include providing plant fibers such as banana fiber, degumming the plant fibers, and dyeing the plant fibers. The methods may further include softening the plant fibers and texturing the plant fibers. The plant fiber may be provided in bundles of varying sizes.

Preferably, the plant fiber comprises banana fiber. Banana fiber is generally produced from the stems and stalks of the banana tree. The fibers can be collected by stripping apart sheaths of banana stem with a knife, retting, combing, or by chemical extraction. Many species and varieties of banana are used to produce banana fiber, and any may be used for the methods described herein. Additionally, it is envisioned that other cellulosic plant fibers, such as sisal and pineapple, could be used instead of banana fiber to achieve similar results.

Degumming the plant fiber may be accomplished by any degumming methods known in the art, including steam explosion, soaking the plant fiber in an alkaline solution followed by soaking the plant fiber in an aqueous alkaline hydrogen peroxide solution, soaking the plant fiber in a solution comprising a degumming enzyme, alcohol hydrolysis and combinations thereof. Preferably, the degumming is accomplished by soaking the plant fiber in an aqueous alkaline solution (also referred to herein as an "alkaline pre-soak") followed by soaking in an alkaline hydrogen peroxide solution.

The alkaline pre-soak solution comprises a base and water as a solvent. The base may comprise sodium hydroxide, lithium hydroxide, potassium hydroxide, rubidium hydroxide, cesium hydroxide, ammonium hydroxide, sodium carbonate, or combinations thereof. Preferably, the base comprises sodium hydroxide. The base may have a concentration in the alkaline pre-soak solution of about 0.1 wt % to about 5 wt %; for example, about 0.1 wt % to about 0.5 wt %, about 0.1 wt % to about 1 wt %, about 0.1 wt % to about 2 wt %, about 0.1 wt % to about 3 wt %, about 0.1 wt % to about 4 wt %, about 0.5 wt % to about 1 wt %, about 0.5 wt % to about 2 wt %, about 0.5 wt % to about 3 wt %, about 0.5 wt % to about 4 wt %, or about 0.5 wt % to about 5 wt %. Preferably, the base may have a concentration of about 1 wt %.

The alkaline pre-soak solution may have a pH from about 7 to about 11; for example, from about 7 to about 8, about 7 to about 9, about 7 to about 10, about 8 to about 9, about 8 to about 10, about 8 to about 11, about 9 to about 10, about 9 to about 11, or about 10 to about 11. Preferably, the alkaline hydrogen peroxide solution has a pH of about 9 to about 11; for example, about 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, or about 11.0. The alkaline pre-soak solution may have a temperature of about 40° C. to about 60° C., such as about 40° C., 45° C., 50° C., 55° C., or about 60° C.

The alkaline pre-soak solution may further comprise an enzyme. The enzyme may comprise pectinase, polygalacturonase, lignin peroxidase, one or more xylanases, or combinations thereof. The enzyme may have a concentration in the alkaline soak of about 0.1 wt % to about 0.2 wt %; for example, about 0.1 wt %, about 0.11 wt %, about 0.12 wt %, about 0.13 wt %, about 0.14 wt %, about 0.15 wt %, about 0.16 wt %, about 0.17 wt %, about 0.18 wt %, about 0.19 wt %, or about 0.2 wt %. Preferably, the enzyme has a concentration in the alkaline soak of about 0.15 wt % to about 0.2 wt %, or more preferably about 0.14 wt % to about 0.18 wt %. In an exemplary embodiment, the enzyme has a concentration in the alkaline soak of about 0.16 wt %.

The enzyme may have an enzymatic activity in the alkaline soak from about 50 units per gram (U/g) of plant fiber to about 150 U/g; for example, about 50 U/g to about 75 U/g, about 50 U/g to about 100 U/g, about 50 U/g to about 125 U/g, about 75 U/g to about 100 U/g, about 75 U/g to about 125 U/g, about 75 U/g to about 150 U/g, about 100 U/g to about 125 U/g, about 100 U/g to about 150 U/g, or about 125 U/g to about 150 U/g. Preferably, the enzyme may have an enzymatic activity in the alkaline soak of about 75 U/g to about 125 U/g, or more preferably about 75 U/g to about 100 U/g.

The alkaline hydrogen peroxide solution may comprise hydrogen peroxide, a base, and water as a solvent. The base may comprise sodium hydroxide, lithium hydroxide, potassium hydroxide, rubidium hydroxide, cesium hydroxide, ammonium hydroxide, sodium carbonate, or combinations thereof. Preferably, the base comprises sodium hydroxide. The base may have a concentration in the alkaline hydrogen peroxide solution of about 0.1 wt % to about 5 wt %; for example, about 0.1 wt % to about 0.5 wt %, about 0.1 wt % to about 1 wt %, about 0.1 wt % to about 2 wt %, about 0.1 wt % to about 3 wt %, about 0.1 wt % to about 4 wt %, about 0.5 wt % to about 1 wt %, about 0.5 wt % to about 2 wt %, about 0.5 wt % to about 3 wt %, about 0.5 wt % to about 4 wt %, or about 0.5 wt % to about 5 wt %. Preferably, the base may have a concentration of about 1 wt %.

The alkaline hydrogen peroxide solution may have a hydrogen peroxide concentration from about 1 wt % to about 10 wt %. Preferably, the alkaline hydrogen peroxide solution may have a hydrogen peroxide concentration of about 5 wt %.

Preferably, the alkaline hydrogen peroxide solution further comprises a stabilizer. The stabilizer functions to stabilize the hydrogen peroxide, which otherwise would degrade rapidly. The stabilizer may comprise a sulfate salt such as magnesium sulfate, calcium sulfate, strontium sulfate, barium sulfate, lithium sulfate, sodium sulfate, potassium sulfate, ammonium iron sulfate, or combinations thereof. Alternatively, or additionally, the stabilizer may comprise a citrate salt, such as sodium citrate, lithium citrate, potassium citrate, magnesium citrate, calcium citrate, strontium citrate, barium citrate, or combinations thereof. Preferably, the stabilizer comprises magnesium sulfate, sodium citrate, or ammonium iron sulfate. The stabilizer may have a concentration in the alkaline hydrogen peroxide solution of about 0.1 wt % to about 1 wt %; for example, about 0.1 wt %, about 0.2 wt %, about 0.3 wt %, about 0.4 wt %, about 0.5 wt %, about 0.6 wt %, about 0.7 wt %, about 0.8 wt %, about 0.9 wt %, or about 1 wt %. Preferably, the stabilizer has a concentration in the alkaline hydrogen peroxide solution from about 0.1 wt % to about 0.5 wt %, or more preferably about 0.1 wt % to about 0.25 wt %.

The alkaline hydrogen peroxide solution may have a pH from about 7 to about 11; for example, from about 7 to about 8, about 7 to about 9, about 7 to about 10, about 8 to about 9, about 8 to about 10, about 8 to about 11, about 9 to about 10, about 9 to about 11, or about 10 to about 11. Preferably, the alkaline hydrogen peroxide solution has a pH of about 9 to about 11; for example, about 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, or about 11.0.

The plant fiber may be soaked in the alkaline hydrogen peroxide solution for a period from about 2 minutes to about 5 minutes, such as from about 2 minutes to about 3 minutes, about 2 minutes to about 4 minutes, about 3 minutes to about 5 minutes, or about 4 minutes to about 5 minutes. Preferably, the plant fiber is soaked in the alkaline hydrogen peroxide solution for a period of about 3 minutes.

The alkaline hydrogen peroxide solution may have a temperature from about 75° C. to about 100° C.; for example, about 75° C., 80° C., 85° C., 90° C., 95° C., or about 100° C. In some embodiments, the alkaline hydrogen peroxide solution may have a temperature from about 75° C. to about 80° C., about 75° C. to about 85° C., about 75° C. to about 90° C., about 75° C. to about 95° C., about 80° C. to about 100° C., about 85° C. to about 100° C., about 90° C. to about 100° C., or about 95° C. to about 100° C.

It has been found that as the temperature of the alkaline hydrogen peroxide solution increases, the time the plant fiber must soak to complete the degumming decreases. For example, at 100° C. plant fiber should soak for about 2 minutes; whereas at 75° C., plant fiber should soak for about 10 minutes to complete the degumming.

Optionally, the plant fiber may be soaked in boiling water before and/or after the alkaline hydrogen peroxide soak. The plant fiber may be soaked in boiling water for about 15 minutes. Preferably, the plant fiber is soaked in boiling water only before the alkaline hydrogen peroxide soak, as it was surprisingly discovered that doing so helped to comb dust off of the plant fiber.

Prior to degumming the plant fiber, the plant fiber may optionally be soaked in an acid pre-soak solution. The acid pre-soak solution may comprise an acid such as a strong acid, an organic acid, or a combination thereof. The strong acid may comprise sulfuric acid, hydrochloric acid, chloric acid, hydrobromic acid, nitric acid, hydroiodic acid, perchloric acid, or combinations thereof. The organic acid may comprise acetic acid, formic acid, glycolic acid, lactic acid, citric acid, oxalic acid, uric acid, malic acid, tartaric acid, and combinations thereof. The plant fiber may soak in the acid pre-soak solution from about 20 minutes to about 2 hours; for example, about 20 minutes, 30 minutes, 40 minutes, 50 minutes, 1 hour, 1.25 hours, 1.5 hours, 1.75 hours, or about 2 hours. In exemplary embodiments, the plant fiber is soaked for about 1 hour in the acid pre-soak solution.

The acid may have a concentration in the pre-soak solution from about 0. 1 wt % to about 1 wt %, such as from about 0.1 wt % to about 0.25 wt %, about 0.1 wt % to about 0.5 wt %, about 0.1 wt % to about 0.75 wt %, or from about 0.1 wt % to about 1 wt %. In some examples, the acid may have a concentration of about 0.1 wt %, 0.2 wt %, 0.3 wt %, 0.4 wt %, 0.5 wt %, 0.6 wt %, 0.7 wt %, 0.8 wt %, 0.9 wt % or about 1 wt %.

The acid pre-soak solution may have a pH from about 1 to about 3.5; for example, about 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4 or about 3.5. In some embodiments, the acid pre-soak solution may have a pH from about 1 to about 3, or more preferably from about 1.5 to about 2.5, or even more preferably of about 2.

The acid pre-soak solution may have a temperature from about 50° C. to about 75° C.; for example, about 50° C., 55° C., 60° C., 65° C., 70° C., or about 75° C. In some embodiments, the acid pre-soak solution may have a temperature from about 50° C. to about 55° C., about 50° C. to about 60° C., about 50° C. to about 65° C., about 50° C. to about 70° C., or about 55° C. to about 75° C., about 60° C. to about 75° C., about 65° C. to about 75° C., or about 70° C. to about 75° C.

Optionally, the plant fibers may be soaked in boiling water before the acid pre-soak. The plant fibers may be soaked in boiling water for about 15 minutes.

After degumming, the plant fibers are rinsed in a cold water bath before dyeing. The dye solution comprises a dye and water, and may further comprise a salt and soda ash.

The dye may comprise a dye powder such as a reactive dye powder, a disperse dye powder, a direct dye powder, a basic dye powder, an acid dye powder, or a combination thereof. Alternatively, the dye may comprise a permanent hair dye. A permanent hair dye operates by oxidation of precursor materials such as para-phenylenediamine (PPD), meta-phenylenediamine (MPD), para-aminophenol (PAP), and/or resorcinol with the aid of an oxidant (e.g., hydrogen peroxide) and a base (e.g., ammonium hydroxide).

Preferably, the dye powder is operable to permanently dye the fibers. Preferably, reactive dye powders are used for colors such as black, red, yellow, and blue. Alternatively, or additionally, the dye may comprise p-phenylenediamine or m-phenylenediamine for a black dye. The dye powder may have a concentration in the dye solution from about 0.001 wt % to about 1.00 wt %, such as from about 0.001 wt % to about 0.005 wt %, about 0.001 wt % to about 0.01 wt %, about 0.001 wt % to about 0.05 wt %, about 0.001 wt % to about 0.1 wt %, about 0.001 wt % to about 0.5 wt %, about 0.005 wt % to about 1 wt %, about 0.01 wt % to about 1 wt %, about 0.05 wt % to about 1 wt %, about 0.1 wt % to about 1 wt %, or from about 0.5 wt % to about 1 wt %.

The dye solution may further comprise a salt. The salt may comprise a chloride salt, such as sodium chloride, potassium chloride, lithium chloride, calcium chloride, magnesium chloride, strontium chloride, barium chloride, or combinations thereof. The salt may comprise a carbonate salt, such as sodium carbonate (also referred to herein as soda ash), lithium carbonate, potassium carbonate, magnesium carbonate, calcium carbonate, strontium carbonate, barium carbonate, or combinations thereof. The salt may comprise a sulfate salt, such as sodium sulfate, lithium sulfate, potassium sulfate, calcium sulfate, magnesium sulfate, strontium sulfate, barium sulfate, or combinations thereof. Preferably, the salt is a non-iodized salt. The salt may have a concentration in the dye solution of about 5 wt % to about 15 wt %; for example, about 5 wt % to about 10 wt %, or about 10 wt % to about 15 wt %, about 5 wt %, about 6 wt %, about 7 wt %, about 8 wt %, about 9 wt %, about 10 wt %, about 11 wt %, about 12 wt %, about 13 wt %, about 14 wt %, or about 15 wt %.

The dye solution may further comprise soda ash. The soda ash may be present in a concentration from about 0.5 wt % to about 1.5 wt %; for example, about 0.5 wt %, about 0.6 wt %, about 0.7 wt %, about 0.8 wt %, about 0.9 wt %, about 1 wt %, about 1.1 wt %, about 1.2 wt %, about 1.3 wt %, about 1.4 wt %, and about 1.5 wt %.

The dye solution may further comprise an organic acid to neutralize the dye solution and/or adjust the pH of the dye solution. The organic acid may comprise acetic acid, citric acid, formic acid, glycolic acid, lactic acid, oxalic acid, uric acid, malic acid, tartaric acid, and combinations thereof. Preferably, the organic acid comprises acetic acid. The organic acid may have a concentration in the dye solution from about about 0.1 wt % to about 1 wt %, such as from about 0.1 wt % to about 0.25 wt %, about 0.1 wt % to about 0.5 wt %, about 0.1 wt % to about 0.75 wt %, about 0.25 wt % to about 1 wt %, about 0.5 wt % to about 1 wt %, or about 0.75 wt %. Preferably, the concentration of the organic acid in the solution is from about 0.1 wt % to about 0.5 wt %, or more preferably about 0.25 wt %.

The dye solution may have a pH from about 9 to about 11, such as about 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, or about 11.0. Preferably, the dye solution has a pH of about 9.5 to about 10.5, or even more preferably of about 10.

After dyeing, the dyed banana fiber may be scoured, softened, sealed, detangled, combed, dried, and/or conditioned. These steps may be performed to improve the appearance and texture of the final synthetic hair product. These steps may be performed in the following order: scouring, softening, conditioning, detangling sealing, and drying; however, this order of performance is not required.

The scouring may be performed to clean the dyed banana fiber and remove impurities, leftover dye, etc. The scouring may be accomplished by scrubbing the dyed banana fiber with a scouring solution comprising a detergent (such as a commercial liquid detergent), sodium laureth sulfate, cocamidopropyl betaine, Synthrapol®, and combinations thereof.

The detergent may have a concentration in the scouring solution of about 0.01 wt % to about 1 wt %, such as from 0.01 wt % to about 0.05 wt %, about 0.01 wt % to about 0.1 wt %, about 0.01 wt % to about 0.5 wt %, about 0.05 wt % to about 1 wt %, about 0.1 wt % to about 1 wt %, or about 0.5 wt % to about 1 wt %.

The sodium laureth sulfate may have a concentration in the scouring solution of about 0.01 wt % to about 0.05 wt %, or more preferably about 0.03 wt %.

The cocamidopropyl betaine may have a concentration in the scouring solution of about 0.005 wt % to about 0.05 wt %, or more preferably of about 0.01 wt %.

The softening may be performed to improve the texture of the dyed plant fiber. The softening may accomplished by soaking the dyed banana fiber in a softening solution comprising a softening agent. The softening agent may comprise butyric acid, cetrimonium bromide, or combinations thereof; furthermore, the softening agent may comprise commercial softening agents, including fabric softeners such as Mil-soft®. Preferably, the softening agent comprises butyric acid. The softening agent may have a concentration in the softening solution of about 0.25 wt %.

The sealing may be performed to trap moisture in the dyed banana fiber to prevent the banana fiber from drying out. The sealing may be accomplished by soaking the dyed banana fiber in a sealing solution. The sealing solution may comprise a solvent or carrier such as an isoalkane, such as a $C_{10}$ isoalkane, a $C_{11}$ isoalkane, a $C_{12}$ isoalkane, or a $C_{13}$ isoalkane. Isoalkanes for use in the solvent or carrier may include isobutane, isopentane, isohexane, isoheptane, isooctane, isononane, isodecane, isoundecane, isododecane, and other isoalkanes and combinations thereof. Preferably, the isoalkane comprises isododecane.

The sealing solution may further comprise one or more emollients. The one or more emollients may comprise isopropyl palmitate, a vegetable oil, squalene, neopentyl glycol diheptanoate, cyclopentasiloxane, diheptyl succinate, carpyloyl glycerine, sebacid acid copolymer, dimethicone, and combinations thereof. The vegetable oil may comprise canola oil, corn oil, cottonseed oil, grapeseed oil, olive oil, palm oil, rapeseed oil, soybean oil, safflower oil, peanut oil, sesame oil, rice bran oil, almond oil, brazil nut oil, cashew oil, hazelnut oil, pecan oil, pine nut oil, pistachio oil, walnut oil, pumpkin seed oil, or other vegetable oils known in the art. Preferably, the vegetable oil comprises grapeseed oil.

The emollient may be present in the sealing solution in a concentration of about 10 wt % to about 100 wt %, such as from about 10 wt % to about 25 wt %, about 10 wt % to about 50 wt %, about 10 wt % to about 75 wt %, about 10 wt % to about 100 wt %, about 25 wt % to about 100 wt %, about 50 wt % to about 100 wt %, or about 75 wt % to about 100 wt %. In some examples, the emollient may be present in the sealing solution in a concentration of about 10 wt %, 15 wt %, 20 wt %, 25 wt %, 30 wt %, 35 wt %, 40 wt %, 45 wt %, 50 wt %, 55 wt %, 60 wt %, 65 wt %, 70 wt %, 75 wt %, 80 wt %, 85 wt %, 90 wt %, 95 wt %, or about 100 wt %. Preferably, the emollient is present in the sealing solution in an amount from about 25 wt % to about 75 wt %, or more preferably from about 45 wt % to about 65 wt %.

The conditioning may be performed to further improve the texture and appearance of the dyed banana fiber. The conditioning may be accomplished by soaking the banana fiber in a conditioning solution and massaging the banana fiber in the conditioning solution. The conditioning solution may comprise water and a conditioning agent. The conditioning agent may comprise a commercial hair conditioner.

The conditioning solution may further comprise a humectant. The humectant may comprise glycerin, propanediol, urea, hyaluronic acid, salicylic acid, glycolic acid, lactic acid, propylene glycol, honey, sorbitol, aloe vera, castor oil, sugar alcohols, or other humectants known in the art. Preferably, the humectant comprises glycerin. The humectant may have a concentration in the conditioning solution of about 45 wt %.

It is to be understood that this disclosure is not limited to the particular methods, compositions, or materials specified herein but is extended to equivalents thereof as would be recognized by those ordinarily skilled in the relevant arts. It should also be understood that terminology employed herein is used for the purpose of describing particular embodiments only and is not intended to be limiting.

Unless defined otherwise, all technical and scientific terms used herein have the same meaning as commonly understood by those of ordinary skill in the art to which the disclosure belongs. Although any methods and materials similar or equivalent to those described herein can be used in the practice or testing of the subject matter of the present disclosure, preferred methods and materials are described. For the purposes of the present disclosure, the following terms are defined below.

As used herein, the term "about" is used to provide flexibility to a numerical range endpoint by providing that a given value may be "a little above" or "a little below" the endpoint. For example, the endpoint may be within 10%, 8%, 5%, 3%, 2%, or 1% of the listed value. Further, for the sake of convenience and brevity, a numerical range of "about 50 mg/mL to about 80 mg/mL" should also be understood to provide support for the range of "50 mg/mL to 80 mg/m L"

As used herein, "comprises," "comprising," "containing," and "having" and the like can have the meaning ascribed to them in U.S. Patent Law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. patent law. "Consisting essentially of" or "consists essentially of" have the meaning generally ascribed to them by U.S. patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. In this specification when using an open ended term, like "comprising" or "including," it is understood that direct support should be afforded also to "consisting essentially of" language as well as "consisting of" language as if stated explicitly and vice versa.

Concentrations, amounts, and other numerical data may be expressed or presented herein in a range format. It is to be understood that such a range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 2 to about 50" should be interpreted to include not only the explicitly recited values of 2 to 50, but also include all individual values and sub-ranges within the indicated range. Thus, included in this numerical range are individual values such as 2, 2.4, 3, 3.7, 4, 5.5, 10, 10.1, 14, 15, 15.98, 20, 20.13, 23, 25.06, 30, 35.1, 38.0, 40, 44, 44.6, 45, 48, and sub-ranges such as from 1-3, from 2-4, from 5-10, from 5-20, from 5-25, from 5-30, from 5-35, from 5-40, from 5-50, from 2-10, from 2-20, from 2-30, from 2-40, from 2-50, etc. This same principle applies to ranges reciting only one numerical value as a minimum or a maximum. Furthermore, such an interpretation should apply regardless of the breadth of the range or the characteristics being described.

EXAMPLES

Examples have been set forth below for the purpose of illustration and to describe certain specific embodiments of the disclosure. However, the scope of the claims is not to be in any way limited by the examples set forth herein. Various changes and modifications to the disclosed embodiments will be apparent to those skilled in the art and such changes and modifications including, without limitation, those relating to the chemical structures, substituents, derivatives, formulations, or methods of the disclosure may be made without departing from the spirit of the disclosure and the scope of the appended claims.

Example 1: Exemplary Process for Preparing Black Hair Bundles

Black hair bundles were prepared using the methods described herein. First, banana fibers were separated into 156 g bundles and secured with a hair tie composed of banana fiber. A single batch consisted of 7×156 g bundles.

Next, an alkaline pre-soak solution was prepared. The alkaline solution was prepared in a brew kettle by combining 52.5 g of sodium hydroxide pellets with 21 liters of tap water. The solution was mixed well until all solids dissolved. The pH of the solution was tested, with a target pH between 11 and 12. The solution was then allowed to heat to a temperature of 100° C. After reaching the desired temperature, 7 bundles were loaded into the kettle and allowed to process for 60 minutes. After 60 minutes, the pH of the solution was reduced to 7. The pH was adjusted by adding concentrated sulfuric acid dropwise to the solution. The bundles were then allowed to soak for an additional 30 min. After 30 minutes, the bundles were removed from the kettle, rinsed under cool water, and set aside for the next step.

Next, an alkaline hydrogen peroxide solution was prepared. To prepare the solution, 13 liters of tap water was added into a brew kettle. Next, 33 g of magnesium sulfate hepta-hydrate and 133 g of sodium carbonate was added into the kettle and mixed until all solids dissolved. The solution was then allowed to heat to a temperature of 90° C. After reaching the desired temperature, the 7 bundles from above were loaded into the kettle. 662 g of 30% hydrogen peroxide was added into the kettle and the bundles were allowed to soak for 3 min. After 3 min, the bundles were removed from the kettle, rinsed under cool water, and set aside until they were ready to be dyed.

To prepare the dye bath, 13 liters of tap water was added into a brew kettle. Next, 1324 g of sodium chloride was added into the kettle and mixed well until all of the solids dissolved. The kettle was then allowed to heat to 60° C. Once the salt was fully dissolved, 81.90 g black dye, 32.76 g red dye, and 49.14 g yellow dye was added into the kettle and mixed well until all of the solids were dissolved. Next, the 7 bundles from above were loaded into the kettle and allowed to soak for approximately 10 min. 132 g of sodium carbonate was weighed into a separate beaker. A portion of the dye solution was drained from the kettle into the beaker and this solution was mixed well to dissolve all solids. The sodium carbonate solution was then poured into the kettle and the bundles were gently mixed and allowed to soak for 60 minutes. After 60 minutes, the kettle was drained and the bundles were removed and rinsed under cool water.

A neutralization bath was then prepared in a brew kettle by combining 13 liters of tap water with 119 g of vinegar. The kettle was then allowed to heat to 50° C. Next, the 7 bundles from above were loaded into the kettle and allowed to process for 10 minutes. During this time, a shampoo bath was prepared by combining 13 liters of hot tap water, 18 g sodium carbonate, 3.31 g sodium laureth sulfate, and 0.66 g cocamidopropyl betaine into a separate container. After processing in the neutralization bath for 10 minutes, the bundles were removed and loaded into the shampoo bath. Bundles were gently massaged for 10 minutes in the bath and then rinsed under cool tap water.

Next a softening solution was prepared in a brew kettle by combining 13 liters of tap water with 35 g Milsoft. The solution was mixed well and allowed to heat to a temperature of 60° C. The 7 bundles from above were loaded into the kettle and allowed to process for 10 min. After 10 minutes, the bundles were removed and rinsed under cool tap water until the water ran clear. Each bundle was gently squeezed to remove excess water and then set aside until ready to be detangled.

During detangling, 10 g of conditioner and 45 g of glycerin was gently massaged into each bundle. Combing tools were used to detangle each bundle and fully separate the fibers from each other. After detangling, 10 g of sealant was gently massaged into each bundle. The bundles were then placed in a convection oven and allowed to dry for not more than 2 hours at a temperature of 70° C. Once each bundle had fully dried, they were combed and trimmed to the desired length and shape.

Example 2: Surface Modification of Natural Fibers for Improved Texture

The goal of this project was to improve texture of banana fibers via surface modification. To achieve this goal, the project had two main objectives: (1) chemical treatment for surface modification of banana fibers; and (2) characterization of treated banana fibers.

Previously degummed banana fibers were treated with a variety of chemicals to screen for the best option to use in surface modification. Compounds with a high affinity to banana fiber surfaces may react via hydrogen bonding or electrostatic interactions. The following modifying agents were initially evaluated: cetrimonium bromide (CTAB), tween 80, sodium dodecyl sulfate (SDS), gelatin, and polyethylenimine (PEI). In this screening experiment, CTAB represented a cationic surfactant with a positive charge, tween 80 represented a nonionic surfactant with no charge, SDS represented an anionic surfactant with negative charge, gelatin and PEI each represented polymers. Samples of degummed banana fibers were surface treated by soaking in solutions of their respective modifiers and characterized by FT-IR.

Figure 1B:
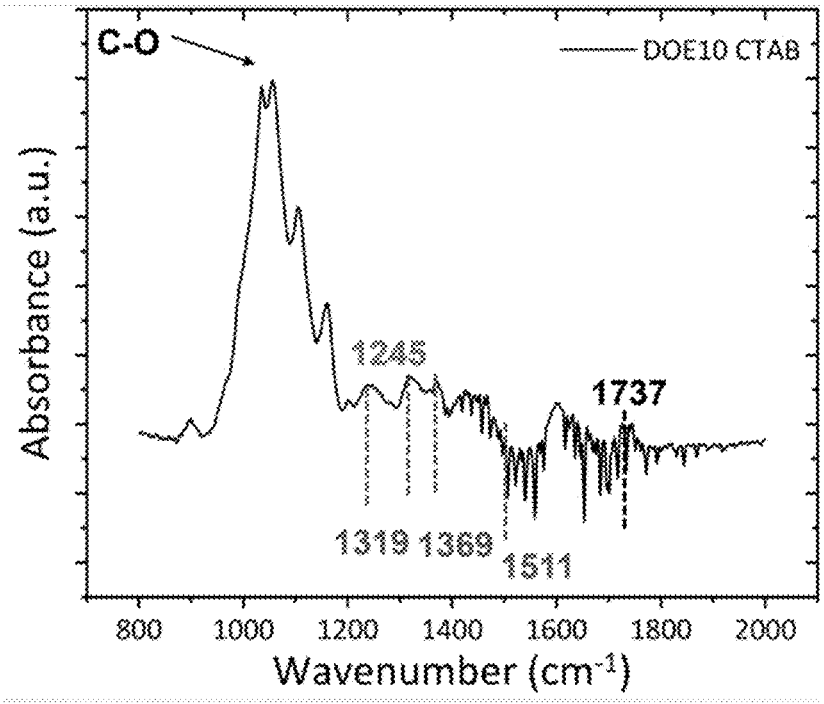
Figure 2A:
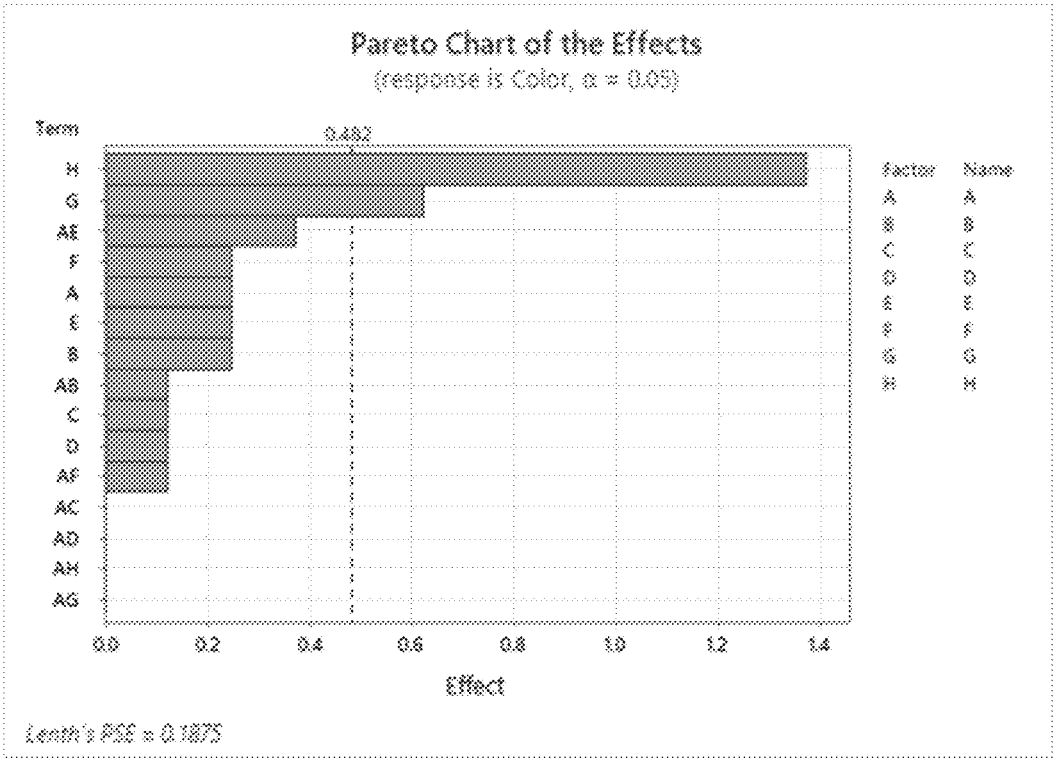
FIGS. 2A-2F show Pareto charts depicting the analysis of the DOE degumming experimental data, as described in Example 2.
Figure 2B:
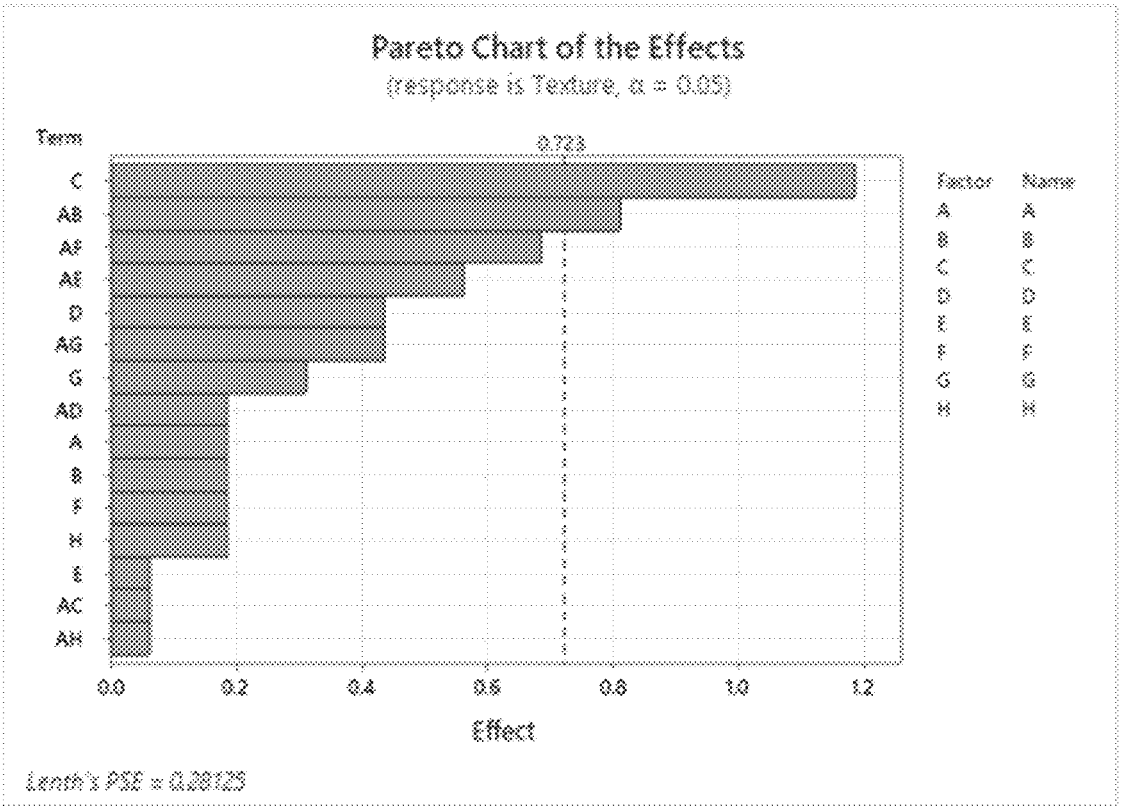
Figure 2C:
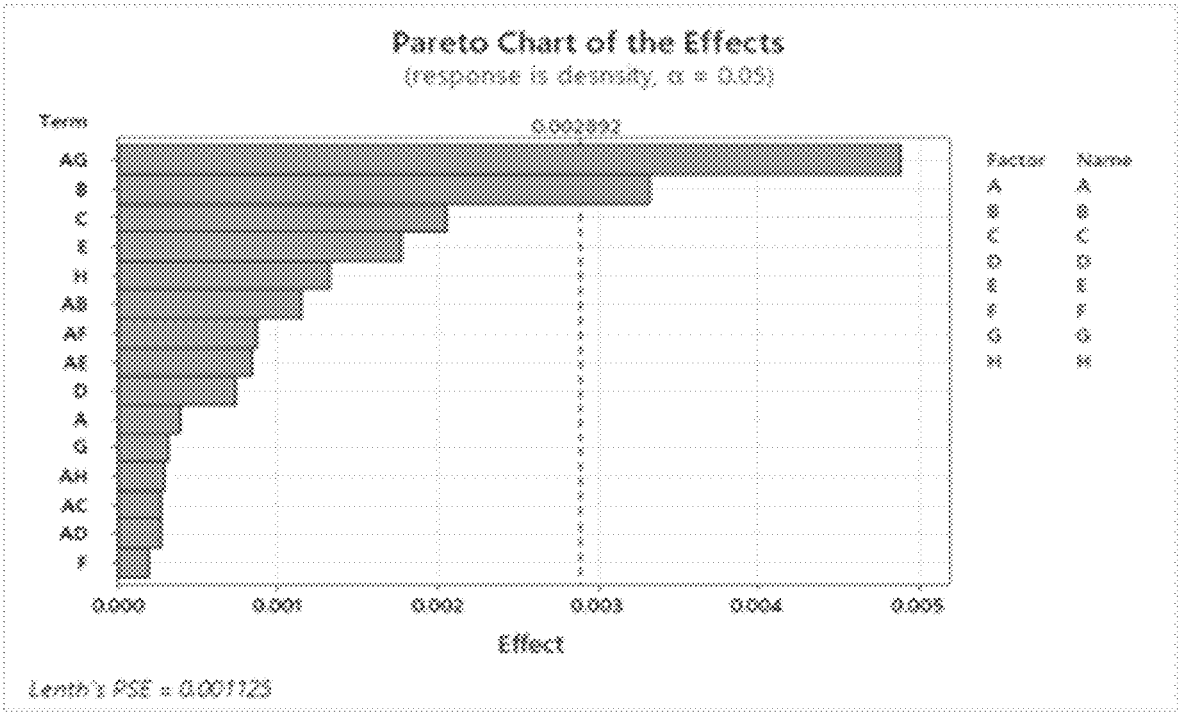
Figure 2D:
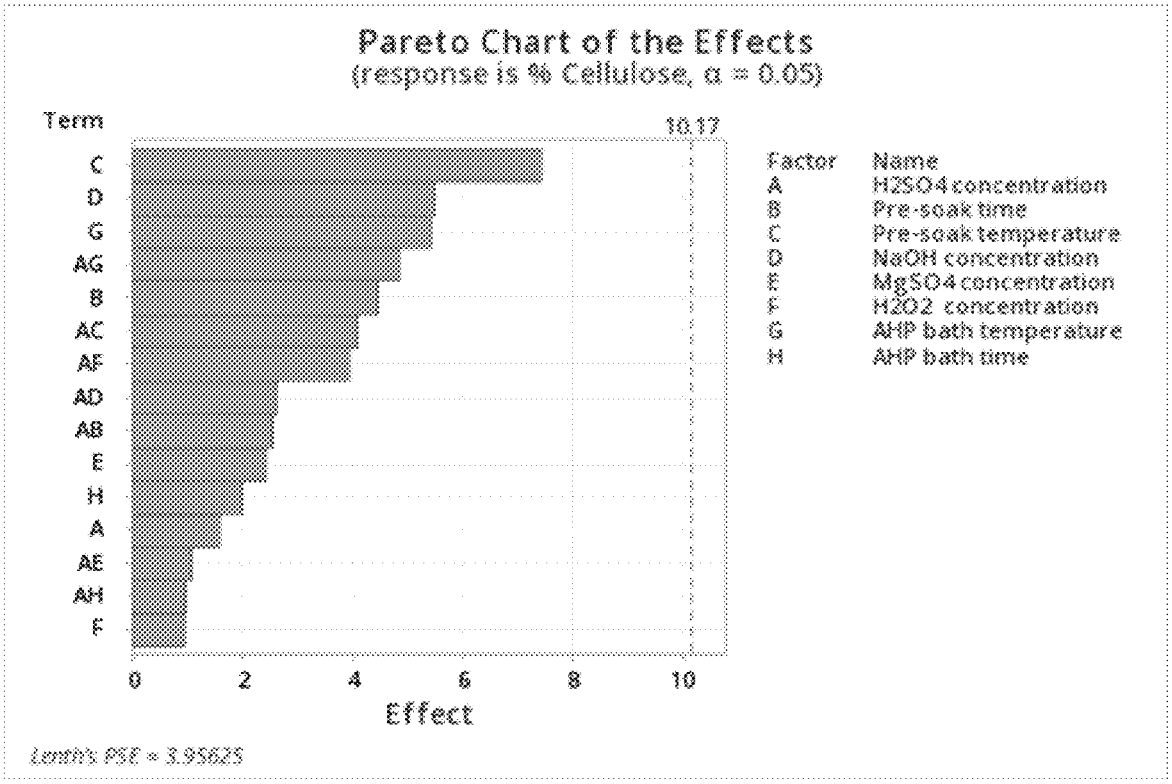
Figure 2E:
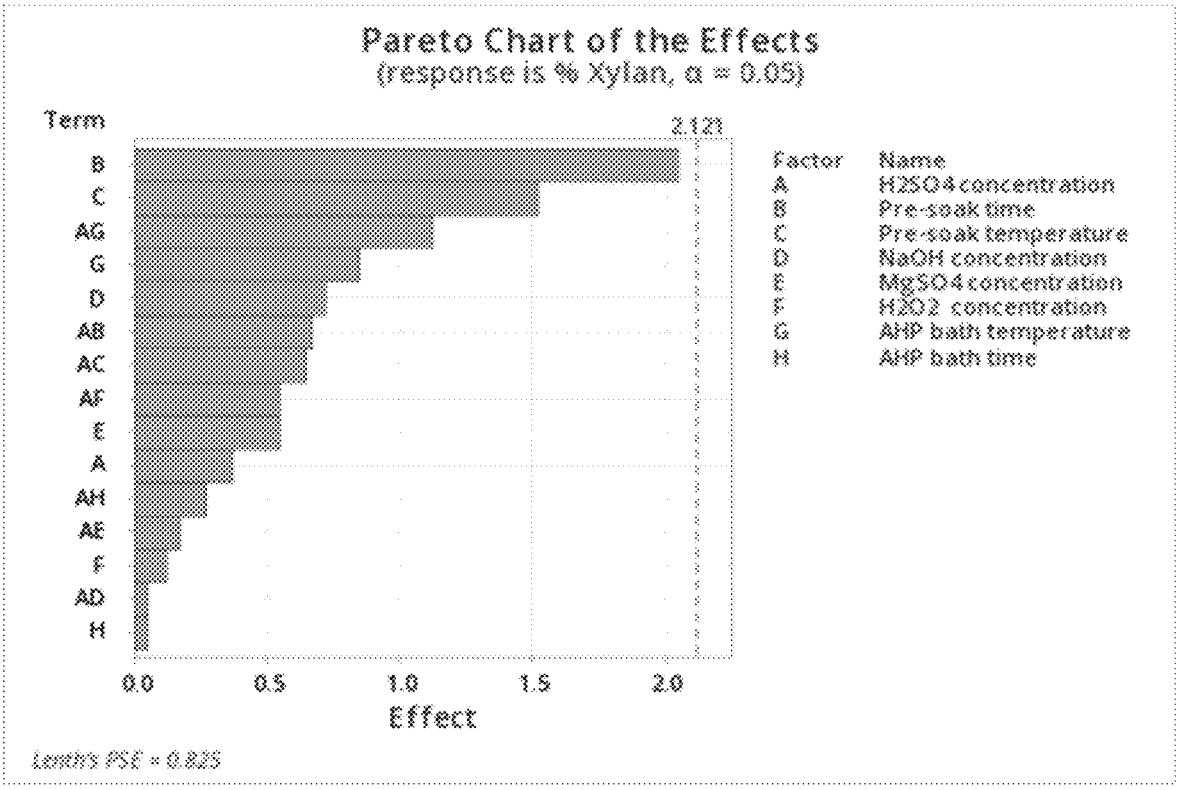
Figure 2F:
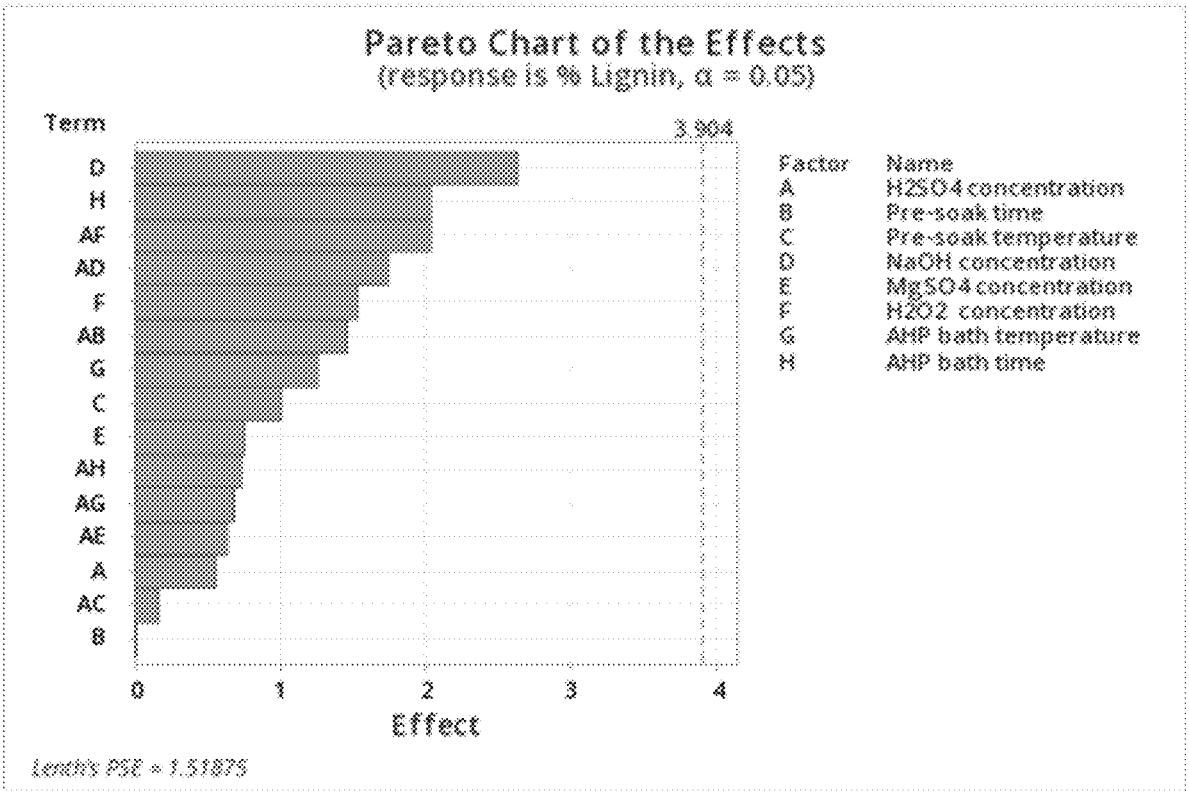
Figure 3A:
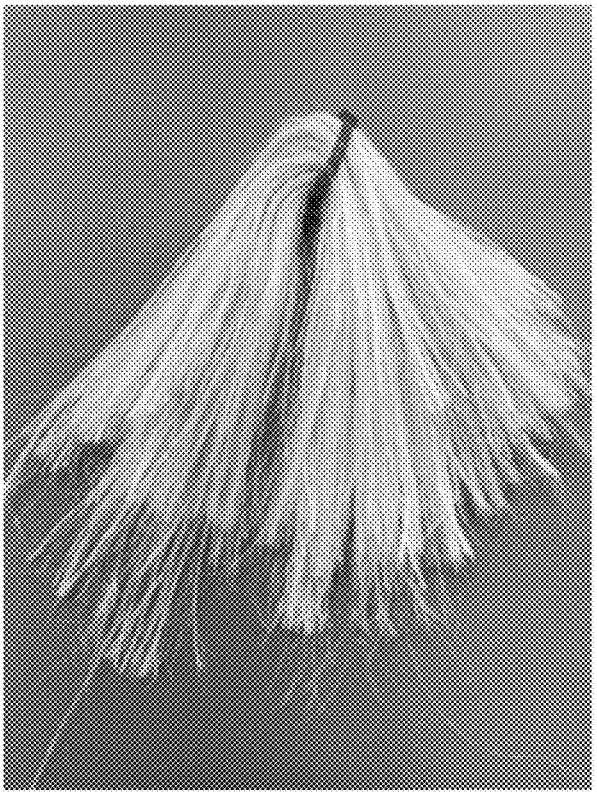
FIGS. 3A-3E shows photographs of the bundles tested in the multifactor degumming experiment described in Example 5.
Figure 3B:
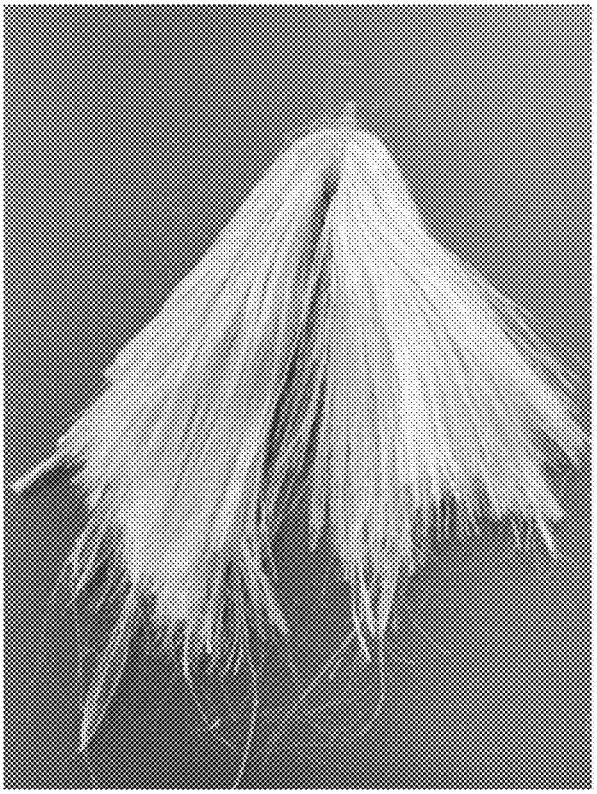
Figure 3C:
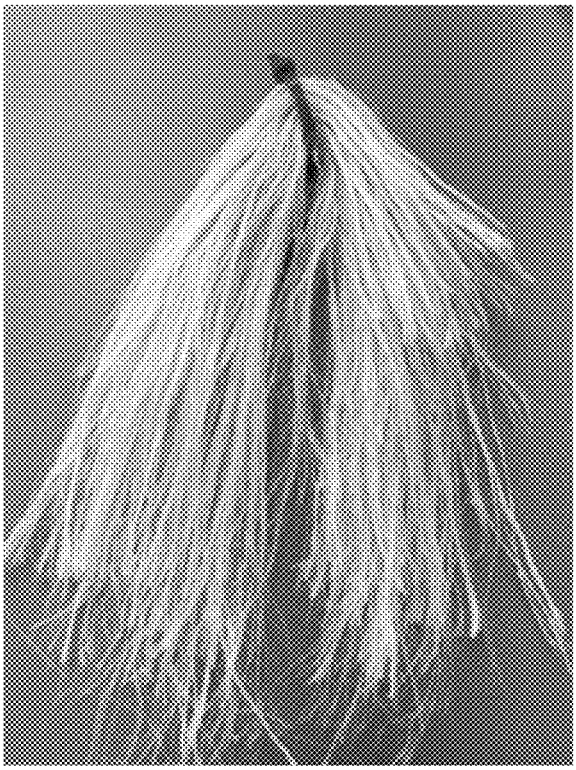
Figure 3D:
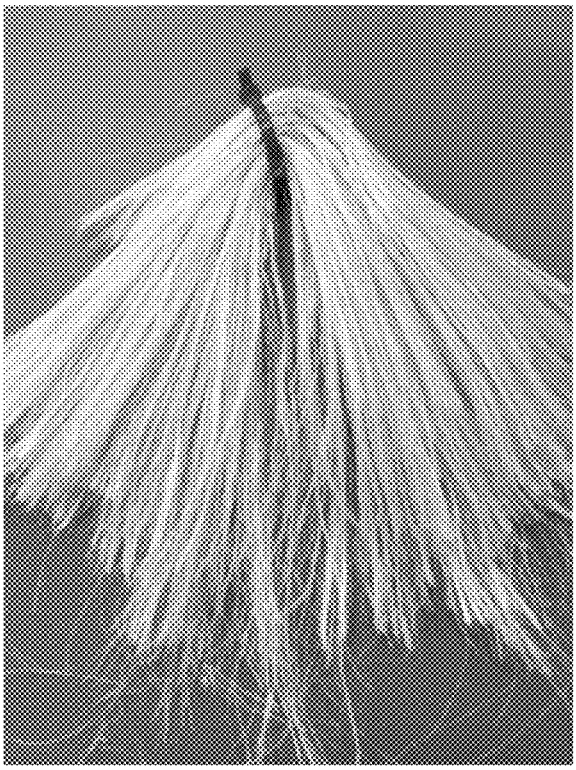
Figure 3E:
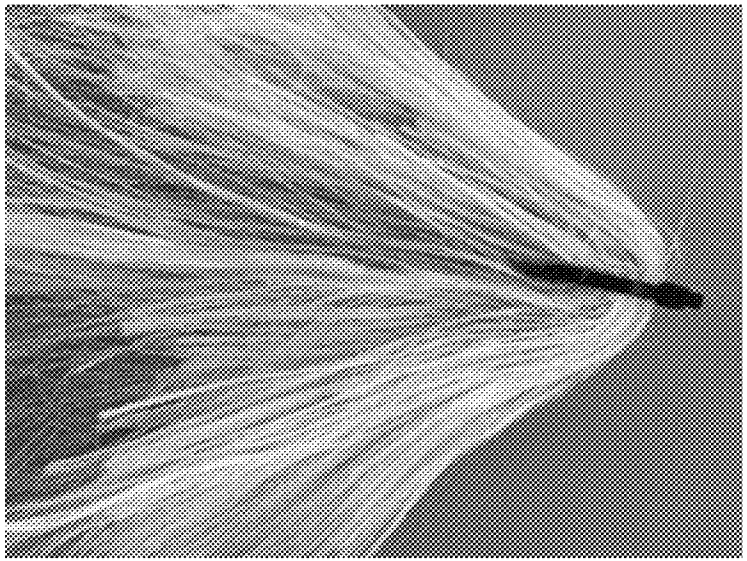
Figure 4A:
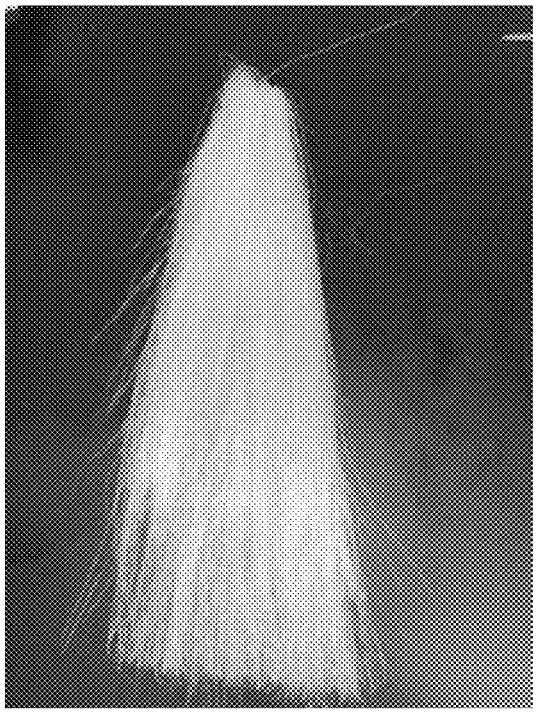
FIGS. 4A-4E shows photographs of the bundles tested in the stabilizer and pre-soak evaluation described in Example 7.
Figure 4B:
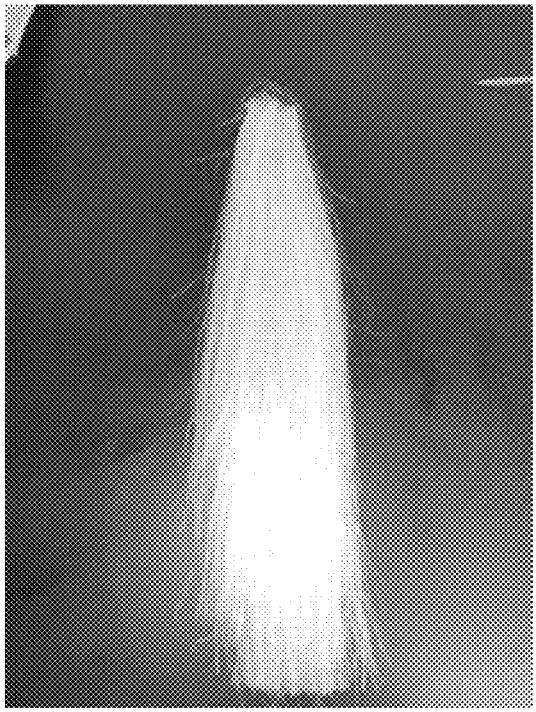
Figure 4C:
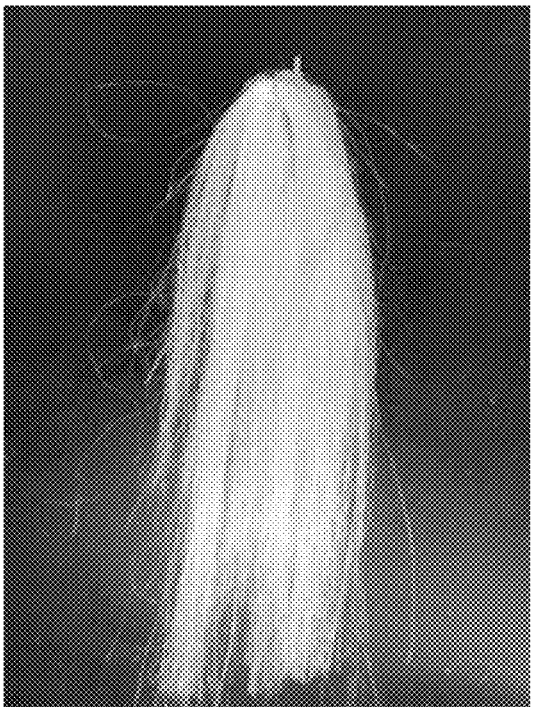
Figure 4D:
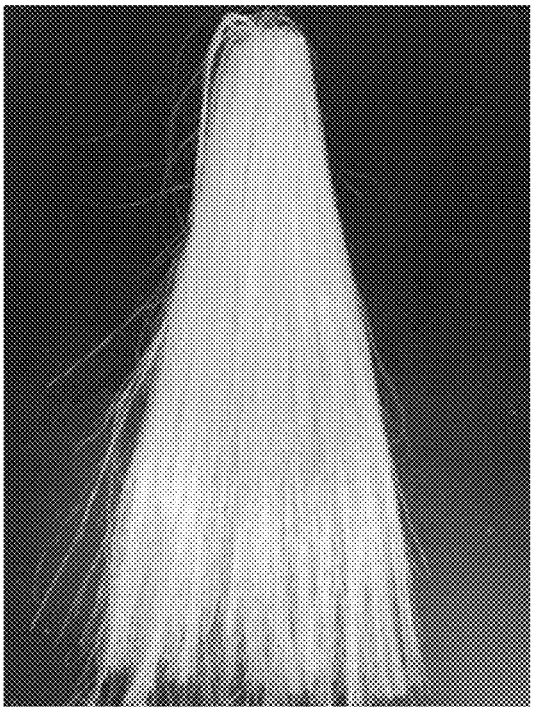
Figure 4E:
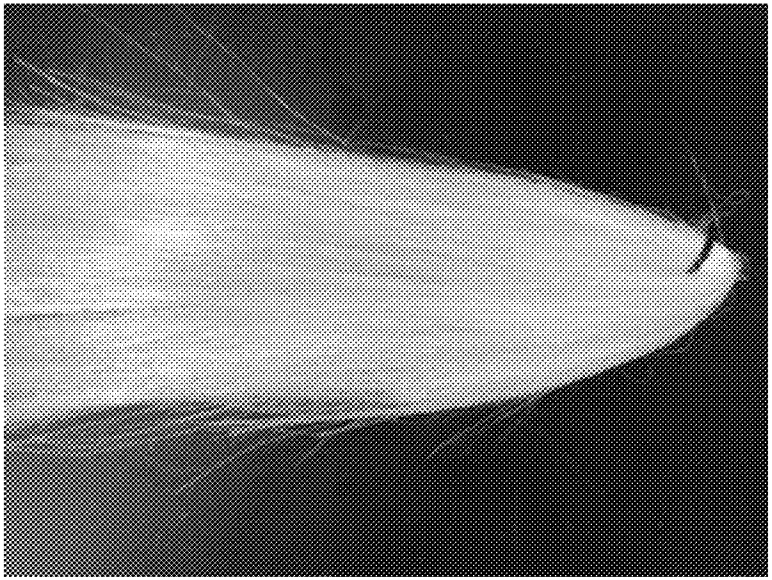
Figure 5A:
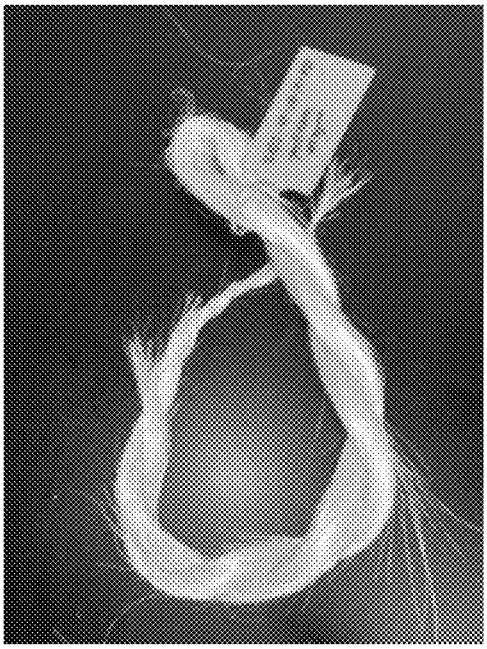
FIG. 5A shows a picture of sample A.
Figure 5B:
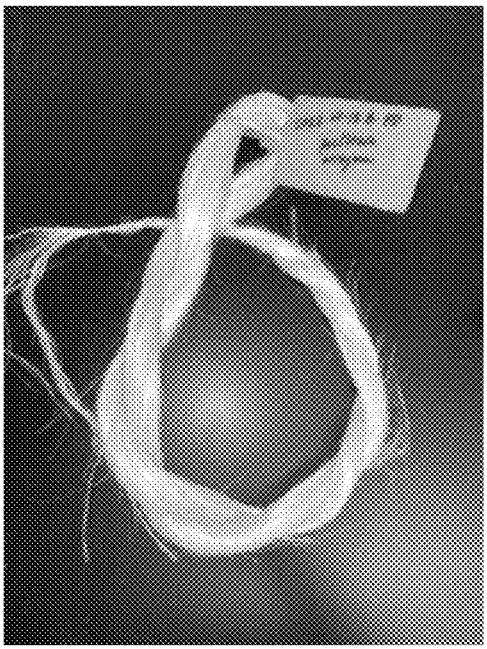
FIG. 5B shows a picture of sample B.
Figure 5C:
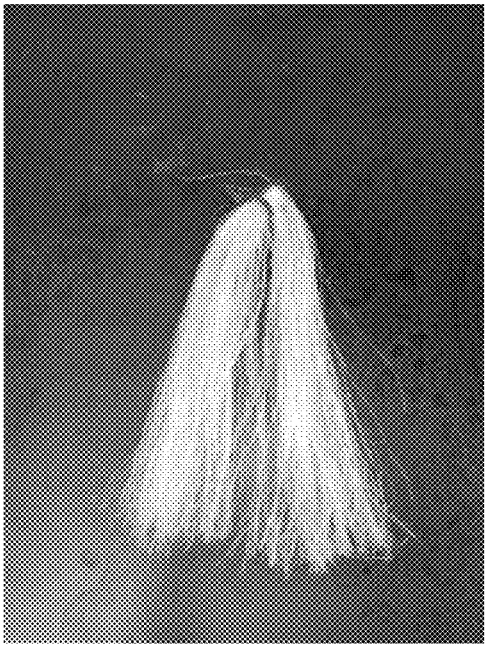
FIG. 5C shows a picture of sample C.
Figure 5D:
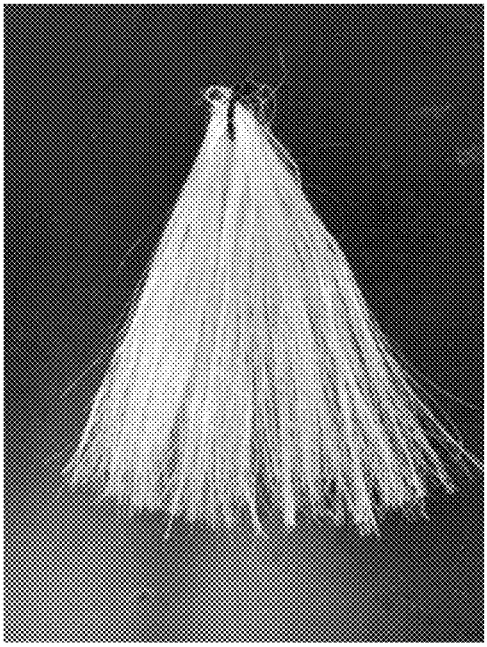
FIG. 5D shows a picture of sample D.
Figure 5E:
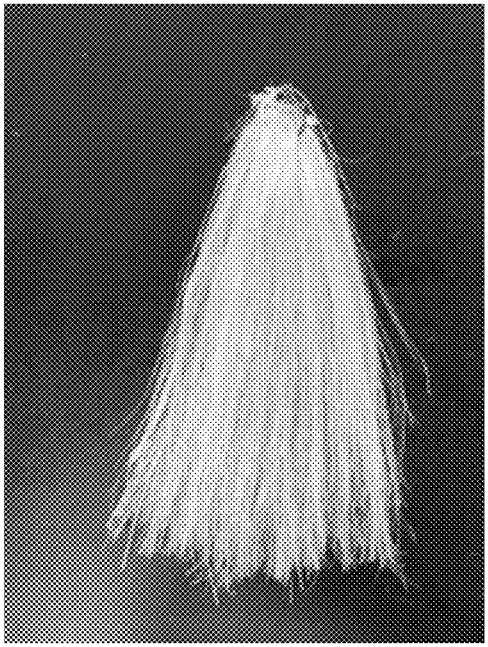

Next, epoxytrimethylammonium chloride (ETMAC) was used to pre-treat freshly degummed fibers prior to soaking the fibers in modifying agents. ETMAC was expected to bond covalently to the fibers allowing for a more stable reaction between the banana fibers and the modifying agents. For this experiment, butyric acid (BA), benzenesulfonic acid (BSA), and dodecylbenzenesulfonic acid (DBSA) were also evaluated as surface modifiers. Fibers that had been treated with ETMAC exhibited a more "frayed" appearance compared to fibers that had not been treated with ETMAC. Soaking the fibers for 1-2 hours in the modifying agents produced fibers with brighter and more smooth surfaces, while fibers that had been soaking for 22 hours were too dry. Butyric acid was the best candidate in improving the feel of smoothness with the fibers, while CTAB worked the best on the overall surface modification. FIGS. 1A and 1B show exemplary FTIR spectra obtained from a bundle before and after treatment with CTAB. The fiber analyzed in FIGS. 1A and 1B was sample 10 from the experiment described in Example 3 below. As can be seen from the FTIR spectra, a peak at around 1245 $cm^{-1}$ appears, likely due to stretching of C—N in the CTAB.

Lastly, surface coating with biopolymers such as gelatin, gluten, and gum arabic was evaluated to determine their impact on the texture of banana fibers. Previously degummed banana fibers were first allowed to soak in 1 wt % glycerin overnight before spray coating with either gelatin, gluten, or gum arabic. The fibers were allowed to dry at 40° C. and were characterized by FTIR. Polymer coating improved the flexibility of the fibers but there remains opportunity for optimizing the polymer choice. In the future, a two-step schema should be used to produce the desired texture of banana fiber. Step 1—Modification with small non-polymeric compounds with an oily moiety and high affinity to fiber surfaces. Step 2—Polymeric coating by physical or chemical reactions to overcome the natural rough texture of the banana fibers while also maintaining its flexibility.

Example 3: Degumming DOE Evaluation

The purpose of this study is to evaluate the relationships of several processing variables on the properties of degummed banana fiber.

A design of experiments (DOE) was used to manipulate the following 8 variables and determine their effect on the response variable of fiber dusting: sulfuric acid concentration, pre-soak time, pre-soak temperature, sodium hydroxide concentration, hydrogen peroxide concentration, magnesium sulfate concentration, AHP bath temperature, and AHP bath time. The dusting is suspected to be undissolved lignin. In respect of time and resources, a 1/16 fractional factorial screening DOE was used to complete a total of 16 experiments.

The low and high values for each factor in the DOE are listed in Table 1.

TABLE 1

Low and high values for factors impacting degumming properties.

| Identifier | Factor | Low | High |
|---|---|---|---|
| A | $H_2SO_4$ concentration | 0.25% | 0.5% |
| B | Pre-soak time | 15 min | 120 min |
| C | Pre-soak temperature | 50° C. | 100° C. |
| D | NaOH concentration | 2 g/L (0.05M) | 5 g/L (0.125M) |
| E | $MgSO_4$ concentration | 0.01% | 0.1% |
| F | 30% $H_2O_2$ concentration | 1% | 2% |
| G | AHP bath temperature | 50° C. | 100° C. |
| H | AHP bath time | 2 min | 60 min |

Method: Sixteen 30 g raw banana fiber bundles were weighed, rinsed, and finger detangled prior to starting the degumming process. The degumming process was completed in multiple phases including an acid pre-soak (phase I) and an alkaline hydrogen peroxide or AHP treatment (phase II).

In phase I, 1000 mL of tap water was transferred into a glass beaker. An appropriate amount of sulfuric acid solution was added to the beaker as described in Table 2 below. The solution was heated on a hot plate to the appropriate temperature described in Table 2. Once the final temperature was reached, a 30 g banana fiber bundle was loaded and allowed to soak for the appropriate time as described in Table 2. Fibers were removed from the beaker, rinsed under lukewarm tap water, and set aside for phase II.

In phase II, 1000 mL of tap water was transferred to a glass beaker. The appropriate amount of magnesium sulfate was weighed into the beaker per Table 2. The appropriate amount of sodium hydroxide was weighed into the beaker as described in Table 2. An appropriate amount of hydrogen peroxide solution (30%) was transferred into the beaker as described in Table 2. The solution was heated on a hot plate to the appropriate temperature. Once the final temperature was reached, pre-soaked fibers were added and allowed to soak for the appropriate time as described in Table 2 below. Fibers were then removed from the beaker, rinsed under lukewarm tap water, and set aside to be labeled for testing.

TABLE 2

Partial factorial design with a total of 16 trials

| Trial | A | B | C | D | E | F | G | H | Total time |
|---|---|---|---|---|---|---|---|---|---|
| 1 | 0.25% | 120 min | 100° C. | 2 g/L | 0.01% | 2% | 50° C. | 60 min | 180 min |
| 2 | 0.25% | 15 min | 100° C. | 2 g/L | 0.1% | 2% | 100° C. | 2 min | 17 min |
| 3 | 0.25% | 15 min | 100° C. | 5 g/L | 0.01% | 1% | 100° C. | 60 min | 75 min |
| 4 | 0.25% | 120 min | 100° C. | 5 g/L | 0.1% | 1% | 50° C. | 2 min | 122 min |
| 5 | 0.5% | 120 min | 100° C. | 5 g/L | 0.1% | 2% | 100° C. | 60 min | 180 min |
| 6 | 0.5% | 15 min | 100° C. | 5 g/L | 0.01% | 2% | 50° C. | 2 min | 17 min |
| 7 | 0.5% | 15 min | 100° C. | 2 g/L | 0.1% | 1% | 50° C. | 60 min | 75 min |
| 8 | 0.5% | 120 min | 100° C. | 2 g/L | 0.01% | 1% | 100° C. | 2 min | 122 min |
| 9 | 0.5% | 120 min | 50° C. | 5 g/L | 0.01% | 1% | 50° C. | 60 min | 180 min |
| 10 | 0.5% | 15 min | 50° C. | 5 g/L | 0.1% | 1% | 100° C. | 2 min | 17 min |
| 11 | 0.5% | 15 min | 50° C. | 2 g/L | 0.01% | 2% | 100° C. | 60 min | 75 min |
| 12 | 0.5% | 120 min | 50° C. | 2 g/L | 0.1% | 2% | 50° C. | 2 min | 122 min |
| 13 | 0.25% | 120 min | 50° C. | 2 g/L | 0.1% | 1% | 100° C. | 60 min | 180 min |

TABLE 2-continued

Partial factorial design with a total of 16 trials

| Trial | A | B | C | D | E | F | G | H | Total time |
|---|---|---|---|---|---|---|---|---|---|
| 14 | 0.25% | 15 min | 50° C. | 2 g/L | 0.01% | 1% | 50° C. | 2 min | 17 min |
| 15 | 0.25% | 15 min | 50° C. | 5 g/L | 0.1% | 2% | 50° C. | 60 min | 75 min |
| 16 | 0.25% | 120 min | 50° C. | 5 g/L | 0.01% | 2% | 100° C. | 2 min | 122 min |

Each sample was analyzed to obtain FTIR spectra, linear densities, fiber characterization and content, and for color and texture. Color and texture were measured subjectively using the scale in Table 3.

TABLE 3

Subjective measurements of color and texture.

| Ratings | Texture | Color |
|---|---|---|
| 1 | Smooth | White |
| 2 | Medium | Light |
| 3 | Slightly Coarse | Medium |
| 4 | Very Coarse | Dark |

The final results are shown in Table 4.

TABLE 4

Summary of DOE results.

| DOE # | Color | Texture | Linear Density (g/m) | Linear Density (tex) | % Cellulose | % Xylan | % Lignin |
|---|---|---|---|---|---|---|---|
| 1 | 2 | 2 | 0.0015 | 1.5 | 64.9 | 11.2 | 11.5 |
| 2 | 3 | 2 | 0.0128 | 12.8 | 59.0 | 12.8 | 10.8 |
| 3 | 1 | 4 | 0.0091 | 9.1 | 69.4 | 11.5 | 6.7 |
| 4 | 4 | 3 | 0.0010 | 1.0 | 66.2 | 9.8 | 12.8 |
| 5 | 1 | 4 | 0.0041 | 4.1 | 86.6 | 7.1 | 3.4 |
| 6 | 3 | 2 | 0.0083 | 8.3 | 67.6 | 12.3 | 8.1 |
| 7 | 2 | 1.5 | 0.012 | 12 | 56.2 | 13.0 | 13.4 |
| 8 | 3 | 3 | 0.0027 | 2.7 | 71.9 | 8.8 | 14.0 |
| 9 | 2 | 1 | 0.0102 | 10.2 | 61.2 | 12.4 | 8.6 |
| 10 | 2.5 | 1.5 | 0.0071 | 7.1 | 60.1 | 12.2 | 12.4 |
| 11 | 1 | 1 | 0.0076 | 7.6 | 61.2 | 13.5 | 10.3 |
| 12 | 3 | 2 | 0.0093 | 9.3 | 53.6 | 11.8 | 12.3 |
| 13 | 2 | 1 | 0.0106 | 10.6 | 61.6 | 11.3 | 11.3 |
| 14 | 3 | 2.5 | 0.0062 | 6.2 | 61.6 | 13.1 | 11.7 |
| 15 | 2 | 1.5 | 0.0099 | 9.9 | 59.0 | 12.4 | 11.4 |
| 16 | 2.5 | 1.5 | 0.0070 | 7.0 | 64.0 | 12.0 | 10.8 |

MiniTab software was used to analyze DOE data using the response factors of color, texture, linear density, cellulose content, lignin content, and xylan content. The results are shown in FIGS. 2A-2F.

Conclusion: Human hair has an average linear density of 0.0065 g/m or 6.5 tex. The DOE samples tested have linear density values that range from 1-13 tex. The degumming process had a significant impact on the linear densities. Additional treatments such as dyeing and softening are likely to impact linear density values as well.

High cellulose content (>75%) is a result of over-processed bundles. The acid pre-soak temperature was the major factor impacting cellulose content. The ideal cellulose content appears to be between 40-65%; therefore, by adjusting the temperature of the acid pre-soak, the desired cellulose levels may be achieved.

Xylan (hemicellulose) content was most impacted by acid pre-soak time and temperature. High temperatures during this step may result in lower xylan content. Therefore, the temperature and soak time during this step may be adjusted to achieve the desired xylan levels, i.e., less than 15%.

Lignin content was most impacted by sodium hydroxide concentration; therefore the pH at the AHP step may be adjusted to achieve the desired lignin levels, i.e., less than 10%.

Example 4: Boiling after AHP Treatment

The effect of adding a boiling step after the AHP treatment (instead of before the acid pre-soak) and increasing the sodium hydroxide concentration in the AHP treatment to 0.4% was evaluated. A 156 g bundle was prepared. The bundle was placed in an acid pre-soak solution at a pH of 1.17 and a temperature of 50° C. for two hours. The AHP soak was then performed at a pH of 11.25 at a temperature of 75° C. for 10 minutes. The bundle was then placed in boiling water for 15 minutes. The bundle was then rinsed, shampooed, conditioned, and detangled. The bundle was allowed to dry in an oven for 1 hour at 75° C., and then finished air drying overnight. The bundle was then evaluated for quality control.

The additional boiling step after the AHP soak appeared to slightly decrease the brightness of the fibers. Therefore, it was recommended to perform the boiling step before the acid pre-soak solution.

Example 5: Multifactor Degumming Experiment

Several factors were tested in an attempt to improve the degumming process. The sample and the description of the factor tested are shown in Table 5.

TABLE 5

Factors tested in degumming process.

| Sample Label: | Description: | Justification: |
|---|---|---|
| A | Control | Control |
| B | Increasing $H_2O_2$ concentration in AHP bath to 5% | From DOE results, $H_2O_2$ was shown to be one of the major factors impacting lignin content |
| C | Adding an alkaline soak immediately before the AHP soak | From DOE results, NaOH concentration was shown to be one of the major factors impacting lignin content |
| D | Adding a boiling step after the AHP soak | Previous shampoo experiment showed that boiling the fibers will reduce the amount of dusting |
| E | Replacing the acid pre-soak with a water boil | It is unclear how the acid pre-soak impacts the overall degumming process |

Each bundle weighed 25 g and was cut to a length of 30 cm. The acid pre-soak was conducted with a 0.4% sulfuric acid solution at a 100° C. for 25 minutes for Samples A-D. Sample E was soaked in tap water at 100° C. for 25 minutes.

Next, Sample C was soaked in an alkaline solution comprising 0.25% NaOH at 100° C. for 15 minutes. Samples A, B, D, and E were not soaked in an alkaline solution.

Samples A and C-E were soaked in an alkaline hydrogen peroxide solution that contained 0.25% NaOH and 1.30% $H_2O_2$ at 100° C. for 2 minutes. Sample B was soaked in a solution containing 0.25% NaOH and 5% $H_2O_2$ at 100° C. for 2 minutes.

After the alkaline hydrogen peroxide soak, Sample D was boiled in tap water at 100° C. for 2 minutes.

Each bundle was then rinsed, shampooed, conditioned, and detangled. The bundles were dried in the oven for 1 hour at 75° C., and then air dried overnight.

The bundles are shown in FIGS. 3A-3E. Sample B showed improved softness and brightness as compared to the control sample; however, Samples C-E all showed a decrease in brightness. The level of dusting of each sample was comparable to the control.

Example 6: Acid Pre-Soak Evaluation

Different acids were tested for use in the acid pre-soak solution as alternatives to sulfuric acid. The acid pre-soak was conducted with 100 g of banana fiber. Sulfuric acid was replaced with acetic acid at a concentration of 7.33% to achieve a pH of 3.0. The temperature of the pre-soak solution was decreased to 60° C. and the soak time was increased to 60 minutes. After the acid pre-soak, the fiber underwent an alkaline hydrogen peroxide soak, rinse, shampoo, conditioning, and detangling as described herein. The banana fiber was then allowed to dry in a drying oven for 3.5 hours at 75° C.

The fiber that underwent an acetic acid pre-soak showed an increase in dusting compared to previous samples. However, there was a noticeable decrease in the shedding of shorter fiber strands and fiber breakage.

In an additional experiment, sulfuric acid was used but at a lower concentration (0.01 wt %) to give a pH of about 3.25. Three 50 g bundles were soaked at 75° C. for 1 hour, 2 hours, and three hours. After the acid pre-soak, the bundles underwent an alkaline hydrogen peroxide soak, rinse, shampoo, conditioning, and detangling as described herein. The bundles were then allowed to dry in a drying oven for 3.5 hours at 75° C.

The reduced concentration of sulfuric acid resulted in insufficient degumming of the banana fiber, and the dried fibers appeared dustier. Additionally, longer pre-soak times did not improve the degumming.

Example 7: Stabilizer and Acid Pre-Soak Evaluation

Magnesium sulfate ($MgSO_4$) is used as an alkaline-peroxide stabilizing agent to slow down the degradation of peroxide and to prevent the formation of free radicals. The purpose of this experiment is to evaluate the impact of increasing $MgSO_4$ concentration to 0.25%. In addition, this experiment will also evaluate the impact of replacing NaOH with $Na_2CO_3$, replacing the acid pre-soak with an alkaline step that is neutralized with sulfuric acid after an initial 1 hour soak time, and replacing sulfuric acid with glycolic acid.

Five 25 g bundles of banana fiber were prepared according to the conditions outlined in Table 6. The bundles were then rinsed, shampooed, softened, conditioned, and dried.

TABLE 6

Sample preparation for stabilizer and acid pre-soak evaluation

| Sample | Preparation |
|---|---|
| A | Acid pre-soak: treat with 0.4% sulfuric acid at 90° C. for 30 min<br>AHP: treat with 0.25% magnesium sulfate, 0.25% sodium hydroxide, and 5% hydrogen peroxide at 90 C. for 3 min |
| B | Acid pre-soak: treat with 0.4% sulfuric acid at 90° C. for 30 min<br>AHP: treat with 0.25% magnesium sulfate, 1% sodium carbonate, and 5% hydrogen peroxide at 90° C. for 3 min |
| C | Pre-soak: treat with 0.25% sodium hydroxide at 90° C. for 60 min.<br>Neutralize bath with sulfuric acid until a pH of 7 is achieved. Allow bundles to soak for an additional 30 min.<br>AHP: treat with 0.25% magnesium sulfate, 0.25% sodium hydroxide, and 5% hydrogen peroxide at 90° C. for 3 min |
| D | Pre-soak: treat with 0.25% sodium hydroxide at 90° C. for 60 min.<br>Neutralize bath with sulfuric acid until a pH of 7 is achieved. Allow bundles to soak for an additional 30 min.<br>AHP: treat with 0.25% magnesium sulfate, 1% sodium carbonate, and 5% hydrogen peroxide at 90° C. for 3 min |
| E | Pre-soak: treat with 1% glycolic acid at 75° C. for 60 min<br>AHP: treat with 0.25% magnesium sulfate, 1% sodium carbonate, and 5% hydrogen peroxide at 90° C. for 3 min |

The bundles are shown in FIGS. 4A-4E. All samples passed quality control testing. Dusting was not completely eliminated from any sample, although samples C and D appeared to have fewer dust particles remaining on the fibers compared to the other samples.

Next, alkali solutions were prepared to determine whether other alkali solutions could improve dusting in the fibers. Three alkali solutions were tested: ammonium hydroxide, sodium hydroxide, and sodium carbonate.

Sample A was treated by first preparing 100 mL of a solution of 1% ammonium hydroxide having a pH of 11.3. The solution was heated to 75° C. 0.1 g of dust from banana fibers was transferred into the solution and allowed to soak for 1 hour. After 1 hour, the dust particles had not dissolved in the solution. An additional 200 mL of water and 16 mL of 28% ammonium hydroxide was added to the solution. The solution was then heated to 100° C. for another hour. Significant dust particles still remained in the solution.

Sample B was treated by first preparing 100 mL of a solution of 1% sodium hydroxide having a pH of 11.6. The solution was heated to 75° C. 0.1 g of dust from banana fibers was transferred into the solution and allowed to soak for 1 hour. After 1 hour, the dust particles had not dissolved in the solution. An additional 200 mL of water and 4 g of sodium hydroxide was added to the solution. The solution was then heated to 100° C. for another hour. After 1 hour, there was a significant reduction in the amount of dust particles in the solution.

Sample C was treated by first preparing 100 mL of a solution of 1% sodium carbonate having a pH of 10.8. The solution was heated to 75° C. 0.1 g of dust from banana fibers was transferred into the solution and allowed to soak for 1 hour. After 1 hour, the dust particles had not dissolved in the solution. An additional 200 mL of water and 4 g of sodium carbonate was added to the solution. The solution was then heated to 100° C. for another hour. Significant dust particles still remained in the solution.

Thus it was concluded that boiling the dust particles in a solution of sodium hydroxide was able to remove most dust particles.

Example 8: Enzyme Evaluation

The use of enzymes to degum banana fibers was evaluated. Preparation of Samples A-E is shown in Table 7.

TABLE 7

Sample preparation for enzyme evaluation

| Sample | pH | Duration | Fiber Weight | Bath size | Liquor ratio | Enzyme | Enzymatic Activity |
|---|---|---|---|---|---|---|---|
| A | 10.0 | 120 min | 50 g | 1000 mL | 1:20 (5% solid loading) | 8 mL | 96 U/g BF (600 U/mL) |
| B | 10.0 | 180 min | 50 g | 1000 mL | 1:20 (5% solid loading) | 8 mL | 96 U/g BF (600 U/mL) |
| C | 10.0 | 60 min | 5 g | 100 mL | 1:20 (5% solid loading) | 5 mL (5%) | 96 U/g BF (stock = 96 U/mL ) |
| D | 10.0 | 60 min | 5 g | 100 mL | 1:20 (5% solid loading) | 10 mL (10%) | 192 U/g BF (stock = 96 U/mL ) |
| E | 10.0 | 60 min | 5 g | 100 mL | 1:20 (5% solid loading) | 15 mL (15%) | 288 U/g BF (stock = 96 U/mL ) |

A glycine-NaOH buffer was prepared. To a 1000 mL volumetric flask, 3.75 g of glycine and 1.28 g of sodium hydroxide were added, followed by about 800 mL of distilled water. The final pH was adjusted to about 10.0. Additional distilled water was added to bring the solution to 1000 mL.

Enzyme-1 (alkaline pectinase, 600 U/mL) was prepared by adding 1 mL of alkaline pectinase (60,000 U/mL) to a 100 mL volumetric flask, followed by 80 mL of distilled water. The solution was mixed well, and then distilled water was added to bring the solution to 100 mL.

Enzyme-2 (alkaline pectinase, 1200 U/mL) was prepared by adding 2 mL of alkaline pectinase (60,000 U/mL) to a 100 mL volumetric flask, followed by 80 mL of distilled water. The solution was mixed well, and then distilled water was added to bring the solution to 100 mL.

Enzyme-3 (alkaline pectinase, 96 U/mL) was prepared by adding 8 mL of Enzyme-2 to a 100 mL volumetric flask, followed by 80 mL of distilled water. The solution was mixed well, and then distilled water was added to bring the solution to 100 mL.

Sample A was prepared by weighing 50 g of banana fibers and loading the fibers into a beaker containing 1000 mL of the buffer solution. The buffer solution was then heated to 50° C. Next, 8 mL of Enzyme-1 was added to the beaker. The fibers soaked for 120 min. The pH was measured to be 9.6 throughout the 120 minutes. The fibers were removed and rinsed under lukewarm tap water. Then the fibers were loaded into a beaker containing 950 mL of distilled water, 50 mL of hydrogen peroxide, 10 g of soda ash, 2.5 g of magnesium sulfate at a temperature of 90° C. The fibers were soaked for three minutes before rinsing under lukewarm tap water. The fibers were shampooed using a solution containing about 600 mL of tap water, 1 g of commercial dish detergent, and 1 g of soda ash for 10 minutes at a temperature of 60° C. The fibers were rinsed under lukewarm tap water. The fibers were then softened using a solution containing about 600 mL of tap water and 4.25 g of Milsoft for 10 minutes at a temperature of 60° C. before rinsing the fibers under lukewarm tap water. The fibers were then conditioned, detangled, and dried in an oven.

Sample B was prepared by weighing 50 g of banana fibers and loading the fibers into a beaker containing 1000 mL of the buffer solution. The buffer solution was then heated to 50° C. Next, 8 mL of Enzyme-1 was added to the beaker. The fibers soaked for 180 min. The pH was measured to be 9.6 throughout the 180 minutes. The fibers were removed and rinsed under lukewarm tap water. Then the fibers were loaded into a beaker containing 950 mL of distilled water, 50 mL of hydrogen peroxide, 10 g of soda ash, 2.5 g of magnesium sulfate at a temperature of 90° C. The fibers were soaked for three minutes before rinsing under lukewarm tap water. The fibers were shampooed using a commercial laundry detergent. The fibers were rinsed under lukewarm tap water. The fibers were then dried in an oven.

Sample C was prepared by weighing 5 g of banana fibers and loading the fibers into a beaker containing 95 mL of the buffer solution. The buffer solution was then heated to 50° C. Next, 5 mL of Enzyme-3 was added to the beaker. The fibers soaked for 60 min. The pH was measured to be 9.6 throughout the 60 minutes. The fibers were removed and rinsed under lukewarm tap water. Then the fibers were loaded into a beaker containing 95 mL of tap water, 5 mL of hydrogen peroxide, 1 g of soda ash, 0.25 g of magnesium sulfate at a temperature of 90° C. The fibers were soaked for three minutes before rinsing under lukewarm tap water. The fibers were shampooed using 1 g of commercial dish detergent. The fibers were rinsed under lukewarm tap water and dried in an oven.

Sample D was prepared by weighing 5 g of banana fibers and loading the fibers into a beaker containing 90 mL of the buffer solution. The buffer solution was then heated to 50° C. Next, 10 mL of Enzyme-3 was added to the beaker. The fibers soaked for 60 min. The pH was measured to be 9.6 throughout the 60 minutes. The fibers were removed and rinsed under lukewarm tap water. Then the fibers were loaded into a beaker containing 95 mL of distilled water, 5 mL of hydrogen peroxide, 1 g of soda ash, 0.25 g of magnesium sulfate at a temperature of 90° C. The fibers were soaked for three minutes before rinsing under lukewarm tap water. The fibers were shampooed using a commercial dish detergent. The fibers were rinsed under lukewarm tap water and dried in an oven.

Sample E was prepared by weighing 5 g of banana fibers and loading the fibers into a beaker containing 85 mL of the buffer solution. The buffer solution was then heated to 50° C. Next, 15 mL of Enzyme-3 was added to the beaker. The fibers soaked for 60 min. The pH was measured to be 9.6 throughout the 60 minutes. The fibers were removed and rinsed under lukewarm tap water. Then the fibers were loaded into a beaker containing 95 mL of distilled water, 5 mL of hydrogen peroxide, 1 g of soda ash, 0.25 g of magnesium sulfate at a temperature of 90° C. The fibers were soaked for three minutes before rinsing under lukewarm tap water. The fibers were shampooed using a commercial dish detergent. The fibers were rinsed under lukewarm tap water and dried in an oven.

The Bundles are shown in FIGS. 5A-5E. Processing the raw banana fibers with alkaline pectinase+alkaline peroxide sufficiently degummed and softened the fibers. However, excessive dusting was still present. Additional evaluation is required to determine if combining alkaline peroxidase with additional enzymes such as lignin peroxidase or polygalacturonase will completely eliminate dusting.

Example 9: Sealing Evaluation

The sealing of the banana fibers was evaluated to improve the performance of the synthetic hair and to eliminate dusting. It was believed that adding glycerin or other humectants to the fibers reduced friction and improved the softness of the fibers.

About 15 swatches of degummed banana fibers were weighed (about 25 g damp weight). The bundles were folded in half and secured with a hair tie to form fanned swatches. Glycerin was applied to each swatch in the amounts shown in Table 8 below.

TABLE 8

Sample preparation for sealing evaluation

| Sample | Glycerin wt (g) |
|---|---|
| A | 1 |
| B | 2.5 |
| C | 5 |
| D | 6.25 |
| E | 3.75 |

Each swatch was then sealed with a commercial detangling spray and allowed to air dry overnight. Each bundle was then evaluated for quality control.

Sample C showed the most favorable characteristics, having the least amount of shedding and the most "bounce-back"; i.e., decreased stiffness and increased flexibility and softness.

Next, three 156 g degummed bundles were prepared and towel dried. Glycerin and the emergency detangling spray were added in the amounts shown in Table 9. Each bundle was then dried in a convection oven at 75° C. for 150 minutes. The bundles were then allowed to air dry over the weekend, and were evaluated for quality control.

TABLE 9

Sample preparation for follow-up sealing evaluation

| Sample | Glycerin wt (g) | Detangling Spray wt (g) |
|---|---|---|
| A | 62.4 | 3.12 |
| B | 78 | 3.12 |
| C | 93.6 | 3.12 |

Although all samples passed quality inspection, Sample A yielded the best results, having increased softness, increased flexibility, and decreased shedding of shorter fiber strands.

Example 10: Sealant

Sealants were tested to replace the commercial detangling solution used. The sealant was prepared according to Table 10.

TABLE 10

Sample preparation for sealant evaluation

| Material | Purpose | % w/w | g |
|---|---|---|---|
| Isododecane | Solvent | 45% | 22.5 g |
| Grapeseed Oil | Emollient | 30% | 15 g |
| Isopropyl palmitate | Emulsifier | 5% | 2.5 g |
| Commercial Sealant #1 (diheptyl succinate, capryloyl glycerin, sebacic acid copolymer) | Emollient | 10% | 5 g |
| Commercial Sealant #2 (30% neopentyl glycol diheptanoate, 70% isododecane) | Emollient | 10% | 5 g |
| Total: | | 100% | 50 g |

The commercial sealant #1 was combined with grapeseed oil and mixed well, followed by isopropyl palmitate, commercial sealant #2, and isododecane which were mixed well. The solution was heated in a water bath at a temperature of about 70-80° C. and stirred to mix thoroughly. The mixture was slightly cloudy, possibly due to the grapeseed oil.

A 3 g sample of banana fiber was rinsed under lukewarm water and allowed to soak in a jar of water. The sample was removed and excess water was squeezed out. 1.5 g of glycerin was added to the sample and combed through, followed by 0.5 g of sealant mixture. The sample was dried in an oven at 75° C. for 30 minutes.

Meanwhile, eight 10 g samples of banana fiber were prepared and rinsed under lukewarm water, then allowed to soak in a jar of water. The samples were removed from the jar and excess water was squeezed out. Glycerin and the sealant mixture were applied according to Table 11. Each sample was then dried in a convection oven at 75° C. for 30 minutes. The samples were then evaluated for quality control.

TABLE 11

| Application of Sealant | | |
|---|---|---|
| Sample | Glycerin | Sealant |
| A | 4 g | 0 g |
| B | 4 g | 0.2 g |
| C | 4 g | 0.3 g |
| D | 0 g | 0.3 g |
| E | 3 g | 0 g |
| F | 3 g | 0.2 g |
| G | 3 g | 0.3 g |
| H | 3 g | 0.4 g |
| I | 5 g | 0.5 g |
| J | 5 g | 1 g |
| K | 5 g | 2 g |

Fully saturating the fibers with high concentrations of glycerin and sealant prior to drying them offered the best results. High concentrations of glycerin without any sealant (sample E) resulted in a sticky texture. Applying sealant without any glycerin (Sample D) did not result in the desired levels of softness and flexibility.

Having described the invention in detail, it will be apparent that modifications and variations are possible without departing from the scope of the invention defined in the appended claims.

What is claimed is:

1. A method of making synthetic hair from plant fiber, the method comprising:

providing a plant fiber;

degumming the plant fiber;

conditioning the plant fiber after degumming the plant fiber; and dyeing the plant fiber.

2. The method of claim 1, wherein the plant fiber is banana fiber.

3. The method of claim 1, wherein the degumming comprises soaking the plant fiber in an alkaline hydrogen peroxide solution.

4. The method of claim 3, wherein the alkaline hydrogen peroxide solution comprises a base, magnesium sulfate, and hydrogen peroxide.

5. The method of claim 1, further comprising soaking the banana fiber in an alkaline pre-soak solution prior to degumming the banana fiber.

6. The method of claim 5, wherein the alkaline pre-soak solution comprises water and a strong base.

7. The method of claim 6, wherein the alkaline pre-soak solution further comprises an enzyme.

8. The method of claim 7, wherein the enzyme comprises pectinase.

9. The method of claim 1, further comprising soaking the plant fiber in an acid solution prior to degumming the plant fiber.

10. The method of claim 9, wherein the acid solution comprises a strong acid or an organic acid.

11. The method of claim 1, wherein the dyeing is accomplished with a dye solution comprising dye, a salt, and soda ash.

12. The method of claim 1, further comprising neutralizing the plant fiber after dyeing the plant fiber.

13. The method of claim 1, further comprising rinsing and scouring the plant fiber after dyeing the plant fiber.

14. The method of claim 1, further comprising detangling, combing, and/or braiding the banana fiber after dyeing the banana fiber.

15. A method of degumming banana fiber, the method comprising:

providing banana fiber; and soaking the banana fiber in a degumming solution, the degumming solution comprising:

a base;

magnesium sulfate; and hydrogen peroxide, and conditioning the banana fiber.

16. The method of claim 15, further comprising soaking the banana fiber in an alkaline pre-soak solution and rinsing the banana fiber prior to soaking the banana fiber in the degumming solution.

17. A method of dyeing banana fiber, the method comprising soaking the banana fiber in a dye solution comprising:

a dye;

non-iodized salt; and soda ash; and detangling, combing, and/or braiding the banana fiber after dyeing the banana fiber.

18. The method of claim 17, wherein the dye comprises a reactive dye powder.

19. A synthetic hair composition comprising banana fiber made by the method of claim 1.

* * * * *